US008399816B2

(12) United States Patent
Glasson

(10) Patent No.: US 8,399,816 B2
(45) Date of Patent: Mar. 19, 2013

(54) ROCKET PROPELLED BARRIER DEFENSE SYSTEM

(75) Inventor: Richard O. Glasson, Morris Plains, NJ (US)

(73) Assignee: CPI IP, LLC, East Hanover, NJ (US)

( * ) Notice: Subject to any disclaimer, the term of this patent is extended or adjusted under 35 U.S.C. 154(b) by 1100 days.

(21) Appl. No.: 12/165,759

(22) Filed: Jul. 1, 2008

(65) Prior Publication Data

US 2012/0011996 A1 Jan. 19, 2012

Related U.S. Application Data

(63) Continuation-in-part of application No. 11/030,649, filed on Jan. 6, 2005, now abandoned, and a continuation-in-part of application No. 12/082,237, filed on Apr. 9, 2008, now Pat. No. 8,122,810.

(51) Int. Cl.
*B64D 1/04* (2006.01)
*F41F 7/00* (2006.01)
*B64D 1/00* (2006.01)

(52) U.S. Cl. ..... 244/3.1; 89/1.11; 89/36.01; 89/36.04; 89/36.11; 89/36.16; 244/1 TD; 244/1 R

(58) Field of Classification Search ..... 244/3.1–3.3, 244/1 TD, 1 R; 89/1.11, 36.01, 36.16, 36.17, 89/36.04, 36.11; 342/5–9; 102/335–340, 102/347, 348, 401, 402, 473, 501
See application file for complete search history.

(56) References Cited

U.S. PATENT DOCUMENTS

| | | | | |
|---|---|---|---|---|
| 1,337,920 | A * | 4/1920 | Kohler | 89/1.11 |
| 2,251,918 | A | 8/1941 | Dawson | |
| 2,876,678 | A | 3/1959 | Lyon | |
| 3,173,334 | A | 3/1965 | Landstorm | |
| 3,228,295 | A | 1/1966 | Kane et al. | |
| 3,245,317 | A | 4/1966 | Watson et al. | |
| 3,249,011 | A | 5/1966 | Wermager et al. | |
| 3,263,565 | A | 8/1966 | Dragonetti et al. | |
| 3,412,640 | A | 11/1968 | Nash | |
| 3,568,191 | A * | 3/1971 | Hiester et al. | 342/8 |
| 3,724,373 | A * | 4/1973 | Rivenes | 244/3.27 |
| 3,727,861 | A * | 4/1973 | Swann | 244/3.15 |
| 3,766,880 | A * | 10/1973 | Ramsey et al. | 89/1.11 |
| 4,005,655 | A * | 2/1977 | Kleinschmidt et al. | 244/3.27 |
| 4,040,334 | A | 8/1977 | Smethers, Jr. | |
| 4,149,166 | A | 4/1979 | Null | |
| 4,175,491 | A * | 11/1979 | Thomanek | 244/3.25 |
| 4,208,949 | A | 6/1980 | Boilsen | |
| 4,231,311 | A * | 11/1980 | Longerich | 89/36.16 |
| 4,333,384 | A | 6/1982 | Arnold | |
| 4,409,880 | A | 10/1983 | Fetterly | |
| 4,475,436 | A | 10/1984 | Campbell | |

(Continued)

FOREIGN PATENT DOCUMENTS

JP 2001349696 12/2001

OTHER PUBLICATIONS

Rena Marie Pacella, "A Chopper Shield," Popular Science, vol. 270, No. 6, Jun. 2007, pp. 54-55.

(Continued)

*Primary Examiner* — Bernarr Gregory

(57) ABSTRACT

A system providing a physical-barrier defense against rocket-propelled grenades (RPGs) that is suitable for use on aircraft, ground vehicles and ships. The system includes a propulsion device (for example, a rocket) and a barrier that is attached to the propulsion device by one or more tethers. The barrier includes an inflatable frame. When the propulsion device is launched, an inflator inflates the frame to assume an open state, and the propulsion device pulls the tether and the barrier along a trajectory for intercepting an RPG.

19 Claims, 23 Drawing Sheets

U.S. PATENT DOCUMENTS

| | | | | | |
|---|---|---|---|---|---|
| 4,614,318 | A * | 9/1986 | Gobel | 244/3.21 |
| 4,674,408 | A * | 6/1987 | Stessen | 244/3.22 |
| 4,768,417 | A * | 9/1988 | Wright | 89/1.11 |
| 4,832,288 | A * | 5/1989 | Kendall et al. | 244/3.24 |
| 5,012,717 | A * | 5/1991 | Metersky et al. | 89/1.11 |
| 5,022,470 | A * | 6/1991 | Andersen et al. | 89/1.11 |
| 5,069,109 | A * | 12/1991 | Lavan, Jr. | 89/1.11 |
| 5,187,318 | A | 2/1993 | Sanderson et al. | |
| 5,333,814 | A | 8/1994 | Wallis | |
| RE34,873 | E | 3/1995 | Luttrell | |
| 5,417,139 | A * | 5/1995 | Boggs et al. | 89/1.11 |
| 5,583,311 | A * | 12/1996 | Rieger | 89/1.11 |
| 5,675,104 | A * | 10/1997 | Schorr et al. | 89/1.11 |
| 5,710,423 | A | 1/1998 | Biven et al. | |
| 5,750,918 | A * | 5/1998 | Mangolds et al. | 89/1.11 |
| 5,814,754 | A * | 9/1998 | Mangolds | 89/1.11 |
| 5,898,125 | A * | 4/1999 | Mangolds et al. | 89/1.11 |
| 5,988,036 | A * | 11/1999 | Mangolds et al. | 89/1.11 |
| 6,182,553 | B1 * | 2/2001 | Peterson | 89/1.11 |
| 6,325,015 | B1 | 12/2001 | Garcia et al. | |
| 6,394,016 | B2 | 5/2002 | Swartout et al. | |
| 6,626,077 | B1 * | 9/2003 | Gilbert | 89/1.11 |
| 6,904,838 | B1 * | 6/2005 | Dindl | 89/1.11 |
| 6,957,602 | B1 * | 10/2005 | Koenig et al. | 89/1.11 |
| 6,980,151 | B1 | 12/2005 | Mohan | |
| 7,046,187 | B2 | 5/2006 | Fullerton et al. | |
| 7,066,427 | B2 | 6/2006 | Chang | |
| 7,190,304 | B1 | 3/2007 | Carlson | |
| 7,202,809 | B1 * | 4/2007 | Schade et al. | 244/3.1 |
| 7,328,644 | B2 * | 2/2008 | Vickroy | 89/1.11 |
| 7,412,916 | B2 | 8/2008 | Lloyd | |
| 7,786,417 | B2 * | 8/2010 | Sells, II | 244/3.1 |
| 2006/0169832 | A1 * | 8/2006 | Glasson | 244/3.1 |
| 2007/0261542 | A1 * | 11/2007 | Chang et al. | 89/1.11 |
| 2010/0243799 | A1 | 9/2010 | Al-Qaffas | |

OTHER PUBLICATIONS

Office Action mailed on Jun. 8, 2007 in the related U.S. Appl. No. 11/030,649.

Office Action mailed on Aug. 7, 2007 in the related U.S. Appl. No. 11/030,649.

Office Action mailed on Jun. 28, 2010 in the related U.S. Appl. No. 12/082,237.

Office Action mailed on Nov. 24, 2010 in the related U.S. Appl. No. 12/082,237.

Office Action mailed on Feb. 24, 2011 in the related U.S. Appl. No. 12/082,237.

Office Action mailed on May 3, 2011 in the related U.S. Appl. No. 12/082,237.

Office Action mailed on Jul. 19, 2011 in the related U.S. Appl. No. 12/082,237.

Office Action mailed on Oct. 11, 2011 in the related U.S. Appl. No. 12/082,237.

Office Action mailed on Jul. 18, 2011 in the related U.S. Appl. No. 12/187,842.

* cited by examiner

MINIATURE LINEAR SHAPED CHARGE

LINEAR SHAPED CHARGE PRODUCES
PLANAR CUTTING JET

STOWED FOLDED BARRIER.DEPLOYED AROUND TOW ROCKET AND LAUNCH TUBE

TWO VIEWS OF BARRIER WITH PLEATED FOLD
TOW ROCKET DEPLOYED INSIDE FOLDED BARRIER

ROCKET PROPELLED BARRIER DEFENSE SYSTEM

RELATED CASES

The present application is a continuation-in-part of U.S. patent application Ser. No. 11/030,649, filed Jan. 6, 2005 now abandoned and entitled "Rocket Propelled Barrier Defense System," and a continuation-in-part of U.S. patent application Ser. No. 12/082,237, filed Apr. 9, 2008 , now U.S. Pat. No. 8,122,810 issued on Feb. 28, 2012, and entitled "Rocket Propelled Barrier Defense System," all of which are incorporated herein by reference.

TECHNICAL FIELD

This application relates to the field of defense systems, and more particularly to deployable defense barriers for intercepting a missile threat.

BACKGROUND

The basic concept of a weapons barrier system that is suitable for airborne vehicles raises the problems of size, weight, and stowage. These are critical parameters for aircraft, and they generally oppose the design requirements of a physical barrier that is capable of stopping or defeating a high-explosive missile traveling at extreme velocities (in Vietnam, barriers made of steel chain-link fence were successfully used as a perimeter defense against RPG attacks). A further difficulty is presented by the need for any RPG barrier system to deploy in a very short timeframe (ideally on the order of 200-300 milliseconds).

Portable missile systems are a proliferating threat to aircraft, ground vehicles, and personnel. Authoritative studies such as the RAND Report (published by the RAND Corporation and available at www.rand.org) predict that this threat will increase as all types of missiles become more widely available. Heat-seeking missiles have been identified as a clear and present danger to both military and commercial aircraft. Rocket Propelled Grenades (RPGs) are one of the most deadly insurgent tools against helicopters and ground vehicles. Planned future use of tilt-rotor, hovering military aircraft will add yet another attractive target for these small and relatively inexpensive missiles. Studies indicate that available defense systems, such as IR flares that are simply dropped from an aircraft, are of marginal effectiveness against heat-seeking missiles. Technological advances, such as multi-spectral and filtered IR seekers used in heat-seeking missiles, are directed at further negating the effectiveness of simple dropped flare-type defenses. Laser-based defense systems have been proposed to deal with heat-seeking missiles, but they have not been proved effective to date and are not generally available. Some laser-based proposals are years away from practicality in terms of both technology and cost. Moreover, both laser and flare defense systems are completely ineffectual against both laser-designated and video-guided missiles. They are also useless against unguided threats, such as Rocket-Propelled Grenades (RPGS).

BRIEF SUMMARY OF THE INVENTION

A Rocket-Towed Barrier Defense System according to the principles of the invention would use small solid-fueled rockets to pull one or more barriers into the pathway of an oncoming RPG or missile. The barrier is designed to intercept and defeat the RPG, that is to prevent it from reaching its target, the host vehicle. In one aspect of the invention, a rapidly-inflating frame upon which specific barrier types may be built is deployed.

An inflatable frame according to the principles of the invention can have one or more of the following attributes:

Size—The frame and its attachments may be stowed in a very compact form when deflated.

Weight—The inflated frame uses gas pressure to achieve structural rigidity, so weight of the frame is very low.

Ultra-fast inflation—The frame may be configured with gas inflators distributed through the various chambers. Typical Solid Propellant Inflators (SPI) can discharge in 25 milliseconds. It is proposed that the inflator propellant may be advantageously shaped, such as in a cord, so that pressure-transport latencies throughout the structure are eliminated. This would provide near-instantaneous inflation of the frame.

Flexibility of deployment scenarios—In one scenario, the frame may be inflated at the instant it is pulled clear of its stowage container. This would apply to close-in RPG attack, where there is very little time to react. Alternately, where it may be advantageous, and where time permits; the barrier may be towed away from the host vehicle for some distance prior to inflation. This would allow for better performance exploitation of the tow rocket and more flexibility in maneuvering and positioning. Deploying just before encounter may de-emphasize the need to provide a barrier with good flying characteristics. It should be noted that, in practice, the inflated barrier would only have to loiter in the path of the approaching RPG for a fraction of a second. Reducing the need for post-inflation towing of the barrier would allow for the use of barriers with a larger, less aerodynamic, inflated shape.

In general the barrier system features multi-chambered inflatable frame. Inflation to be via Solid Propellant Inflator, such as sodium azide. SPI propellant may be distributed in cord form throughout the various chambers of the frame, giving near-instantaneous inflation of all chambers simultaneously. This feature is a major requirement for fast defensive response to RPG attack.

Another aspect of the present invention is directed at a system for intercepting projectiles, and will be described with respect to certain projectiles such as missiles including RPG, heat seeking missiles as well as other types of weapon missiles. The system itself includes a propulsion device that is fired from a vehicle or a ground station and which travels through the air by its propulsion at a relatively high velocity. The system includes a barrier that is attached to the propulsion device and which has a deflated state when at rest on the vehicle or ground station and which changes to an inflated state by the aerodynamic forces experienced by the barrier as it passes through the air. The system also includes at least one tether that affixes the barrier to the propulsion device.

The system is intended to intercept or disrupt missiles during flight. While particularly effective against unguided, relatively slow missiles, such as RPG's, the present system can also be used to intercept other missiles, such as guided, fast, longer range missiles such as infrared heat seeking missiles.

An object of the invention is to prevent those missiles from completing their flights and causing damage to their intended targets. The system relies on the fact that missiles of all types are primarily aerospace structures and, while they are fast and deadly, they are designed and constructed to fly through air, not through solid physical barriers such as is provided by a system according to the principles of the invention. A physical barrier of the appropriate construction will cause significant damage to a lightweight aerospace structure such as a missile, during an in-flight encounter. The ability of any missile to inflict damage upon its target depends upon that missile being undamaged and in complete working order when it arrives on the target.

Accordingly, a physical barrier can cause substantial structural damage, bending or shearing off of guidance fins, significant course deflection, and premature detonation by contact. Any one of these effects is likely to defeat the missile. It will be noted that it is not necessary to provide a barrier which will completely capture, or stop, a threat missile, although this might result. Accordingly it may be seen that the major design requirement for the present barrier system is to provide sufficient strength and resiliency to inflict damage or detonation upon encountering a missile.

Another aspect according to the present invention is the provision of improved decoy or obscuration methods against guided missiles. Specifically, a barrier may incorporate infrared decoys, such as flares, which would actually cause a heat-seeking missile to steer towards that barrier, enhancing the probability of interception. Such a system could be used strictly as a decoy system and would provide substantial benefits in terms of the ability to loiter in the flight path of the incoming missile and occlude the target aircraft from the missile seeker. Such a loitering/occluding decoy arrangement would also effectively defeat advanced target discrimination algorithms such as centroid weighting a decoy-equipped barrier could provide both enhanced decoy functionality as well as the ability to intercept and disrupt, as described above.

In another aspect, ordinary methods of guidance may be employed in a propulsion device further enhancing the ability to direct decoys and/or ensure threat interception. As such, a benefit lies in avoiding the need for highly-precise guidance and targeting of the barrier. This is because each barrier offers a wide radius of coverage (occlusion of the target from the view of the threat missile). The radius of occlusion of the target provided by each barrier increases substantially as the barrier draws away from the target and towards the threat. This effect may be further enhanced by launching multiple barriers.

A system according to the invention can utilize existing technologies for the identification and targeting of threats. The system takes advantage of the fact that RPGs and personnel-fired missiles are, in terms of combat projectiles, relatively slow-moving and there time available to identify threats and launch countermeasures. Each launch pod provides a zone of coverage. The actual propulsion device and barrier does not need to precisely intercept the incoming projectile. Furthermore, the launch of several barriers in a pattern toward the path of the incoming threat will provide an increased likelihood of interception. Unlike other proposals, such an explosive ball bearing grenades, this system presents an effective counter to lethal munitions while maintaining a low probability of collateral damage to non-combatants in the launch vicinity.

As a feature of a system according to the principles of the invention, the propulsion device can be a rocket and which can be launched from a vehicle, such as a helicopter, or a land based station.

The barrier useable as a component of an exemplary system can be constructed of special materials that are designed with sufficient strength to carry out the interception of a missile and to either capture or sufficiently divert the missile from its intended path. Exemplary material includes crossing steel wires welded together at crossing interstices, steel wires coat with a plastic material, Kevlar webbing and the like.

There is at least one tether that affixes the barrier to the propulsion device. One characteristic of the tether is that it be strong enough to maintain the integrity between the barrier and the propulsion device while traveling at a relatively high speed through the air while also having an inherent elasticity or give as the missile strikes the barrier. In an exemplary embodiment, there may be a plurality of tethers with one or more of the tethers having differing flexibility than other tethers.

As a still further feature there may be a device that is affixed to or incorporated into the barrier that generates a shock wave at a predetermined time when the barrier is in close proximity to the intercepted or diverted missile so as to cause a self-detonation of the missile, thereby prevent the explosive charge of the missile from reaching its intended target. In one aspect, the shock-generating elements are in the form of planar cutting charges. The charges generate a hypersonic planar cutting jet that can destroy any type of missile by cutting it into separate parts. The cutting charges are detonated as the missile passes by the barrier. Decoy heat sources may be affixed to cause heat-seeking missiles to veer towards the barrier. A towed barrier according to this aspect may consist of only an inflatable frame with the cutting charges disposed inside. No physical barrier material is needed.

In one aspect, when carried aboard a vehicle, such as a helicopter, the barrier of the system in its at rest or non-inflated state, may conveniently be secured to an exterior surface of that vehicle, either by being affixed to the outer skin of the vehicle of to the launch tubes for the propulsion device. Thus, when a propulsion device is activated, the tethers affixed to that propulsion device simply pulls the barrier off of the surface where it is attached in its non-inflated, at rest state to follow the propulsion device to be inflated to its inflated state by aerodynamic forces as the barrier passes through the air.

These and other features and advantages of the present invention will become more readily apparent during the following detailed description taken in conjunction with the drawings herein.

DETAILED DESCRIPTION

Figure 1:
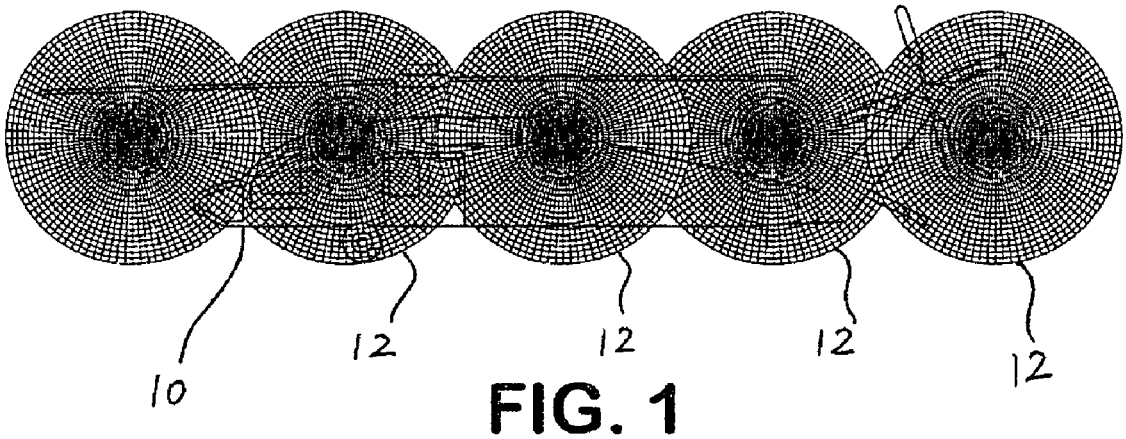
FIG. 1 shows an area of coverage provided by several rocket-towed barriers, superimposed upon the outline of a helicopter.

Turning now to FIG. 1, there is shown a schematic view illustrating a helicopter 10 that is being protected by a plurality of barriers 12 and show the coverage of the protection that can be provided to a vehicle, such as helicopter 10, by the barriers 12 according to the present invention. As can be seen, the barriers 12 are superimposed over the helicopter and are located so as to intercept or deflect a missile aimed at the helicopter 10.

Figure 2A:
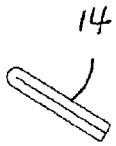
FIGS. 2A-2C show an exemplary launch sequence of a single rocket-towed barrier.
Figure 2B:
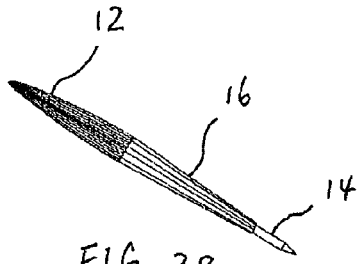
Figure 2C:
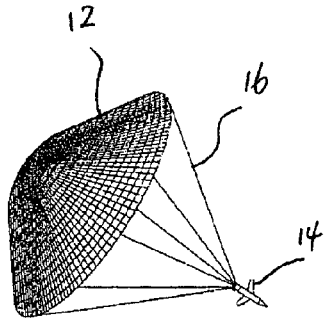

Taking FIGS. 2A-2C, there can also be seen, an exemplary launch sequence. As can be seen in FIG. 2A, initially the propulsion device 14 is being propelled through the air at a relatively high velocity having been launched for a rocket or launch pad of a vehicle such as a helicopter 10 of FIG. 1. At this point, the barrier, not shown, can be in a non-inflated state. Throughout the present description, the inventive system will be described as relative to use with a vehicle such as a helicopter, it being understood, however, that the present invention can be used or deployed from a wide variety of air and land based vehicles or ground stations.

In any event, as illustrated in FIG. 2B, as the propulsion device 14 continues through the air, the aerodynamic forces are applied to the barrier 12 affixed to the propulsion device 14 by means of a plurality of tethers 16 such that the barrier 12 begins to change from its non-inflated prior state to its inflated state.

As such, in FIG. 2C, the barrier 12 has reached it fully inflated state by the aerodynamic forces and is in its inflated state for capturing or diverting a missile in a manner to be later described.

Figure 3:
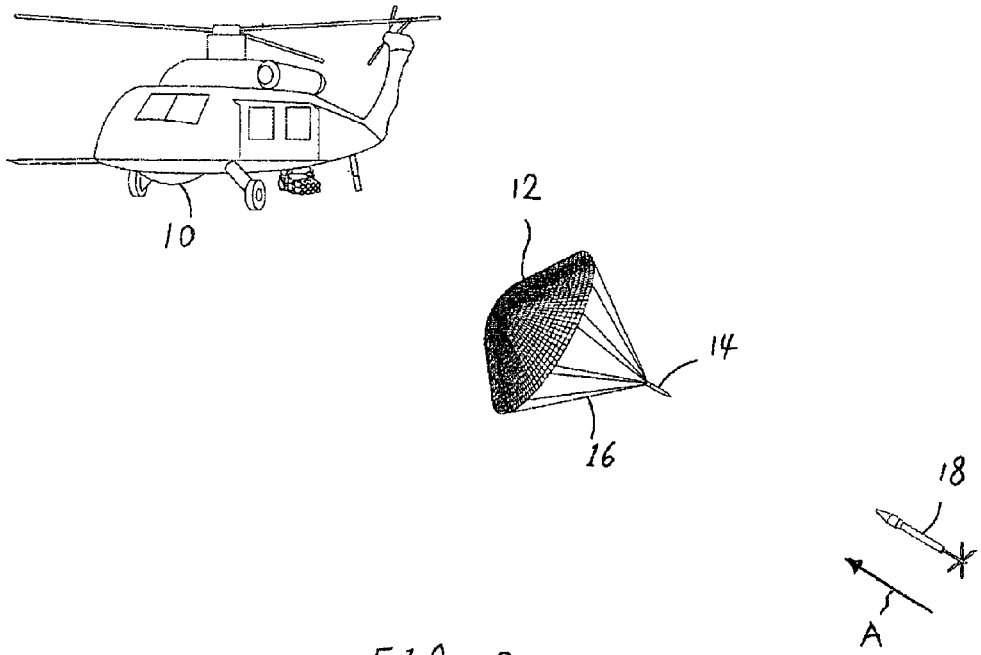
FIG. 3 shows an exemplary rocket-towed barrier on an intercepting course between a helicopter and a threat missile.

Turning now to FIG. 3, there is shown a schematic view of an exemplary system fully deployed and in a position for intercepting or diverting a missile 18 aimed at the helicopter 10. As can therefore be seen, the location of the system is in between the missile 18 and the helicopter 10 with the missile traveling in the direction of the arrow A. The barrier 12 is thus positioned and oriented to capture or divert the missile before it can reach its intended target, the helicopter 10.

The launch of the propulsion device can be carried out by a launch pod affixed to the host vehicle in a conventional manner. In one embodiment, the launch pod is a simple weatherproof cluster of thermoplastic tubes. Launch pods are attached to the host vehicle in such a way that the launch tubes are directed toward the zone from which RPG protection is desired. The system interfaces with a threat identification system, of which there are many in current use. Examples of threat warning and response systems include radars, such as the BAE Systems ALQ-156 pulse-Doppler radar system; infrared detection systems such as Radiance Technologies Weapons Watch® or others. Threat direction and time-to-go data are used to determine the optimum firing time for the RTB countermeasures. In this respect, the system operates similarly to the current chaff or infrared decoy countermeasure systems, with a distinction that the system is designed to physically intercept the threat missile, thereby providing a significantly greater degree of security. By themselves, infrared and chaff decoy systems provide no defense against RPGs, which are essentially ballistic projectiles having no in-flight seek or guidance capabilities.

In another embodiment, the countermeasure-firing pod is actively aimed using rapid-acting electromechanical or fluid powered actuators similar to systems in current use such as the Raytheon Phalanx Close In Weapon System (CIWS). Data from such radar system is used to point the countermeasure launch tube(s) on an approximate intercepting trajectory, taking account of velocities of the threat, the countermeasure, and the host vehicle. The present system would be smaller and simpler than current CIWS systems primarily because the rate of fire is much lower and the projectiles are self-propelled, requiring only a launch tube. An additional simplifying factor is that precise threat intercept (hitting a bullet with a bullet) is not a requirement of the present system. In yet another embodiment, the RTB countermeasure may employ active guidance. This system would offer tracking and in-flight course correction. Assuming active guidance combined with accurate data on the flight path of the threat, it may be possible to deliver the threat munition back to its point of origin.

The propulsion device itself can be a quick firing, single-stage solid-fueled rocket.

As explained, the propulsion device 14 tows the barrier 12 that, after launch, is inflated by aerodynamic forces.

Figure 4:
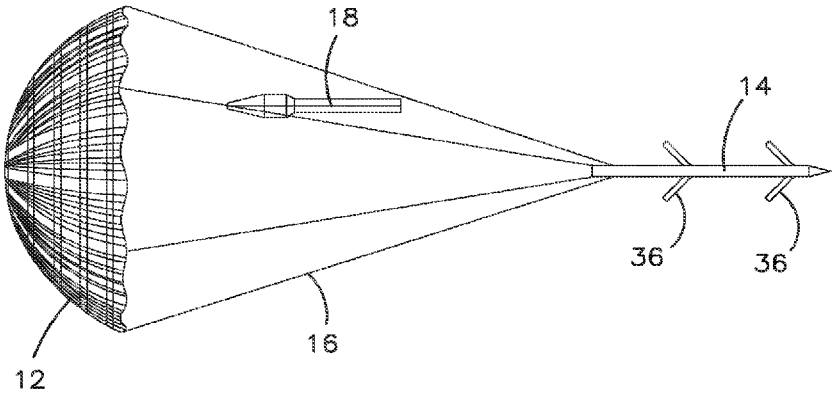
FIG. 4 shows an exemplary system constructed in accordance with the present invention and illustrating a typical barrier.

Turning now to FIG. 4, there is shown a system constructed in accordance with the present invention and illustrating a typical barrier 12 in the shape of a small, flat drogue parachute. The drogue-shaped barrier 12 is aerodynamically symmetric, resembling an aircraft-braking parachute, but is constructed of a particular material that presents a physical barrier to oncoming missiles, while allowing most oncoming air to pass through.

A 4 pound RPG can travel at approximately 600 mph. An important characteristic of the barrier system is that it has a certain give, or momentum transfer from the RPG to the barrier.

In one aspect, a system according to the principles of the invention provides momentum transfer between the towed barrier and the incoming RPG. As explained, the barrier does not have to stop the RPG. Because the barrier is towed behind a rocket, it is not the same as a barrier that is solidly fixed to a massive base. All the barrier system has to do is ensnare the RPG. If that happens, the RPG will have to continue its mission while dragging a bulky and unwieldy mesh barrier, as well as the tow rocket. Additionally, there may be elasticity in the tethers that attach the barrier to the tow rocket. This elasticity will reduce the shock of the RPG encountering the barrier and results in a system that can snag or disrupt the flight of a missile or RPG, but which system does not necessarily stop a RPG.

The analysis of the course diversion of a missile by a barrier is as follows: Momentum equals mass times velocity and may be expressed as a vector equation:

$$p=mv$$

The towed barrier system may be considered as one such system comprising the mass of its parts and the velocity vector of the path of travel:

$$p1=m1v1$$

The incoming RPG (missile) threat may be considered a second system comprising the mass of the RPG (missile) and its respective velocity vector:

$$P2=m2v2$$

An encounter between these two systems may be roughly described by summing these two expressions:

$$m1v1+m2v2=(m1+m2)\cdot vR$$ where $vR$ denotes resultant velocity vector.

In the case where the initial velocity vectors are in substantially opposing directions, the resultant vector, i.e. the direction of travel of the RPG (or missile) after encounter will be substantially different than its initial, or intended, direction. In other words, it will be off course.

The analysis of deflecting the impact energy to prevent barrier breakage is as follows:

It is important that the barrier not break during the encounter. The force vector of the RPG hitting the barrier may be simplified as F=ma, where a is the deceleration of the RPG resulting from the encounter. The major influence on the deceleration is the distance over which the deceleration takes place. There are 3 design factors that will increase this distance, and thus decrease the magnitude of deceleration and resultant force on the barrier.

The barrier is flexible and will likely deform during the encounter.

The barrier tethers will be elastic.

The mass of the barrier system is small, as outlined above, so the encounter will result in re-direction of the travel vector of the barrier, thus deflecting the momentum and acceleration vectors during encounter.

In accordance with these analyses, the mesh material may be Kevlar® fiber, Dyneema® fiber, stainless steel braided cable, or a combination of materials. The mesh is optimized for strength and aerodynamic drag characteristics.

In particular, the barrier 12 can be comprised of a material that is robust in strength but is made up of a mesh so that the air can travel through the barrier 12 as it passes through the air towed by the propulsion device 14 at a relatively high speed, that is, the barrier 12 should be strong but not create an excessive resistance to movement through the air. One construction of a barrier 12 is through the use of braided stainless steel cables.

In the use of stainless steel cables, the joints or crossing points of the cables should be strong enough to resist, since the missile spreading the cables apart so that the missile passes through the barrier 12. Also, with a purely wire mesh, the mesh joints, where the individual cables cross, and need to be attached, absorb most of the energy from the missile by withstanding those spreading forces as the tapered nose of the missile tries to force its way through a particular mesh barrier. Another parameter of the barrier is that is preferable will be contacted solidly by the front of a missile where the missile has a contact detonation device and that encounter can therefore detonate the missile. Accordingly one construction can be with the use of stainless steel cables where the cable junctions or joints would be resistance welded to form a mesh of the desired density and shape such as by spot welding. The joints would not have the ultimate strength as that of the cables themselves but have a significant fraction of that strength. Another method of joining would use metal ferrules that are formed around the intersection of the cables. The joints would not have the ultimate strength as that of the cables themselves but have a significant fraction of that strength. An alternate mesh can be a high strength fiber such as Kevlar®.

The mesh can be embedded in a supplemental matrix that supports the mesh and distributes impact forces beyond just the particular reticule that encounters the missile. In one embodiment, the wire mesh is embedded (molded into or bonded to) in a plastic sheet. A very tough plastic sheet distributes forces through a wider area and adds to the outright strength of the barrier. With the embedded embodiment, the steel cable could be slightly lighter than with the non-plastic embedded embodiments and the material is a composite plastic barrier.

Figure 5:
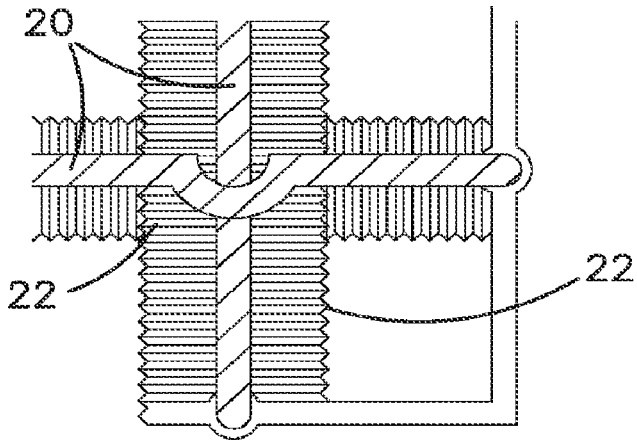
FIG. 5 illustrates an exemplary juncture of steel cables used in the construction of a barrier.

Turning to FIG. 5, there is shown a typical juncture of steel cables 20 spot welded together and embedded into a polymer sheet 22.

Figure 6:
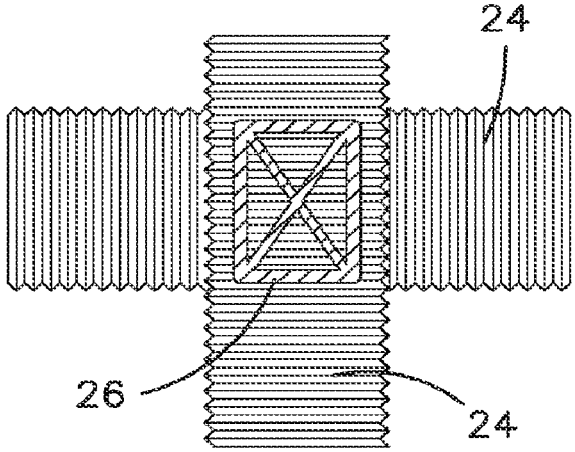
FIG. 6 illustrates an exemplary juncture of a woven material straps used in the construction of a barrier.

In FIG. 6, there is shown a juncture of a woven material straps 24, such as Kevlar and illustrating the box stitching 26 at that juncture.

In other embodiments, there are plastics that can be utilized and which are very tough and become tougher when subjected to mechanical strain. Such plastics are strain hardening plastics such as polycarbonate and which present an effective barrier to even fast moving missiles. As explained, missiles are designed to fly through air, not tough polymer sheets and wire cable. A further advantage of the embodiment of a polymer barrier is shape control and unlimited design latitude with respect to aerodynamic features such as air holes, overall shape and additional features such as guidance vanes, optimal venting for proper drag and light characteristics, vents that cause the barrier to spin, embedded infrared decoy elements, and embedded explosive element as will be later explained. The process of embedding the material in the plastic matrix can be accomplished by "insert molding" or "overmolding".

In summary, in one embodiment, the barrier is formed by welding stainless steel cables into a mesh and then bonding the welded cables to a plastic sheet or embedding the cable mesh between two sheets of plastic that are bonded together with heat or an adhesive. The resultant barrier presents a formidable obstacle to a missile. The steel braided cable can also be covered with a tough coating with a material such as tungsten carbide.

As a still further embodiment of the barrier, the barrier may be comprised of a double layer of any of the aforedescribed described materials or may be a barrier comprised of steel rods in the manner of am umbrella.

Figure 7:
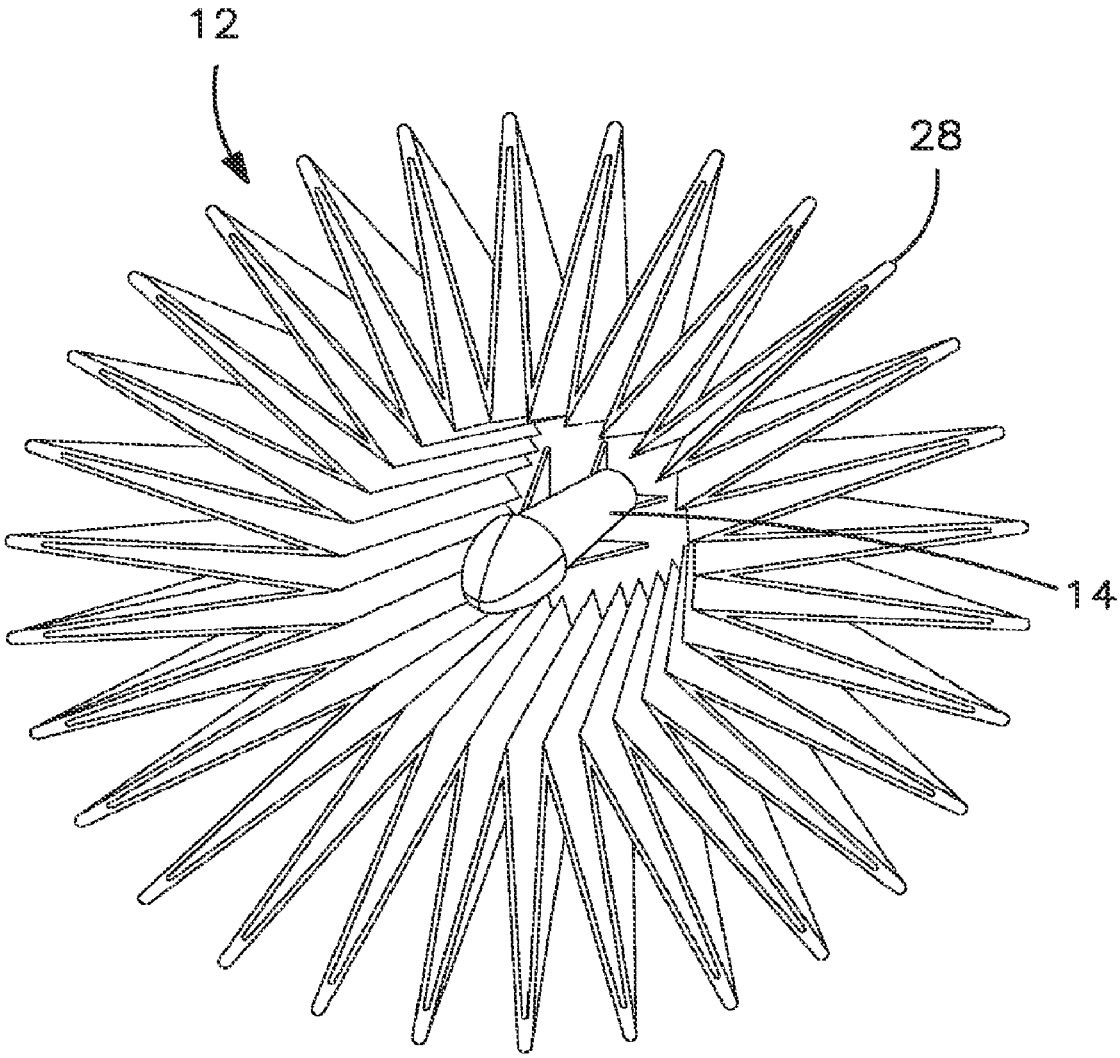
FIG. 7 is a schematic view of an exemplary barrier and which is a circular pleated form.

Turning now to FIG. 7, there is shown a schematic view of a barrier 12 in its at rest state and where the barrier 12 is formed as a circular pleated form such that the barrier 12 has a plurality of pleats 28 surrounding the propulsion device 14 such that the barrier is readily deployed as it is pulled by the propulsion device 14 from the vehicle.

Figure 8:
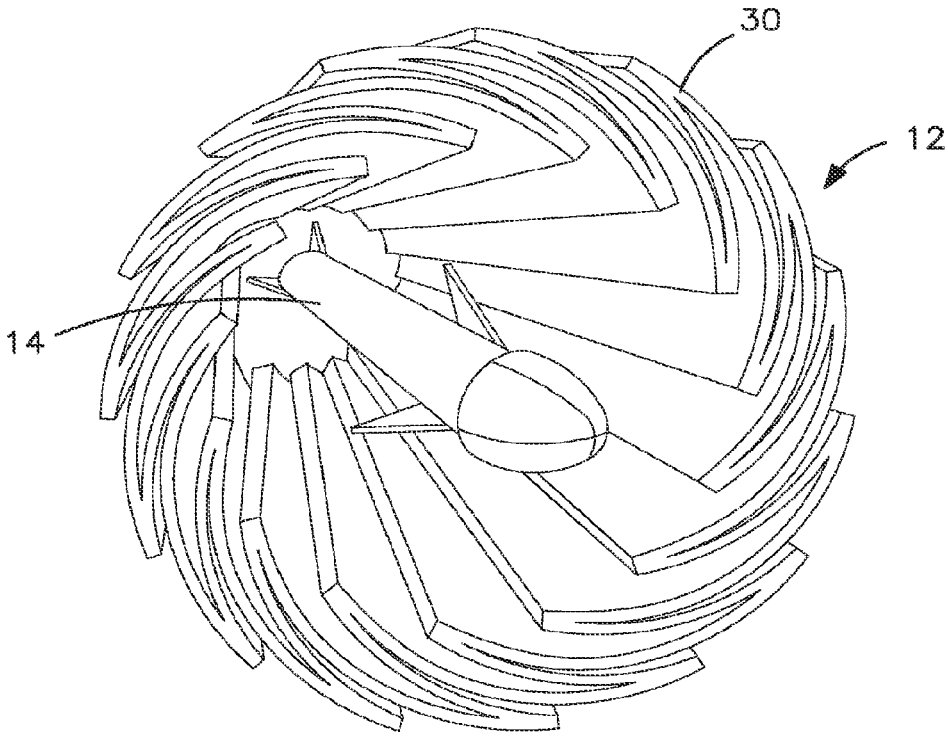
FIG. 8 is a schematic view of a further configuration of an exemplary barrier and which is an overlapping rolled configuration.

In FIG. 8, there is show a schematic view of a further configuration of a barrier and which is an overlapping rolled configuration where there are rounded flaps 30 of the barrier material, such as a polymer, that surround the propulsion device 14 and, again, provides a closely arranged barrier 12 that can be readily pulled and deployed with the activation of the propulsion device 14.

Returning to FIG. 4, there is at least one tether 16 that is used to affix the barrier 12 to the propulsion device 14. The tethers 16 are fixed to the propulsion device 14 in such a way as to provide uniform pull forces when the barrier 12 is inflated. The tethers 16 are constructed to withstand the initial shock of encountering an RPG. The tether system may employ an elastic element to partially dissipate the kinetic energy of a captured or diverted RPG such that the elastic stretches as the intercepted missile impacts the barrier.

The barrier 12 exploits aerodynamic forces to maintain maximum frontal area with respect to the RTB flight path. The overall system can be optimized for threat interdiction. The barrier 12 can be designed to slow the propulsion device 14 to the optimum velocity for maximum time-in-the-path of incoming threats. Mesh barriers of other shapes are operable with this system. In a further embodiment, a mesh barrier of rectangular frontal aspect is deployed. Larger barriers may employ multiple tow rockets in order to maintain the desired cross-section during threat interdiction.

In one embodiment the towed barrier is packed with the propulsion device as a unit. The barrier is folded and wrapped into a compact package that is formed around the propulsion device. At launch, the propulsion device first leaves the launch pod pulling the barrier tethers along behind it. The tethers in turn pull the barrier out of its folded state and out of the launch pod. As the barrier clears the launch pod and proceeds along the flight path, aerodynamic forces cause it to inflate to its maximum diameter. Certain areas of the towed barrier may be subject to high heat from the propulsion device, in particular, the area directly behind the propulsion device.

Since the overall system itself is expendable, and the flight duration is on the order of a few seconds, this would not seriously degrade the effectiveness of the system. With more demanding mission requirements, the towed barrier may be fitted with a heat protective coating in the area of the rocket exhaust. The barrier may be stored as a unit, in its own expendable launch pod. Such a system would facilitate quick and easy replacement of discharged countermeasures, much as current chaff dispensing systems. In another embodiment, the complete launch tube units may be incorporated into a magazine, or an ammunition belt configuration.

In the use of a propulsion device used to tow a barrier, the system provides a storage location for the barrier, particularly when the system is used with an air vehicle, such as a helicopter. Obviously, the barrier must be stored proximate to the propulsion device and yet must be readily freed for deployment when the propulsion device is fired and the tethers pull immediately on the barrier.

Figure 9:
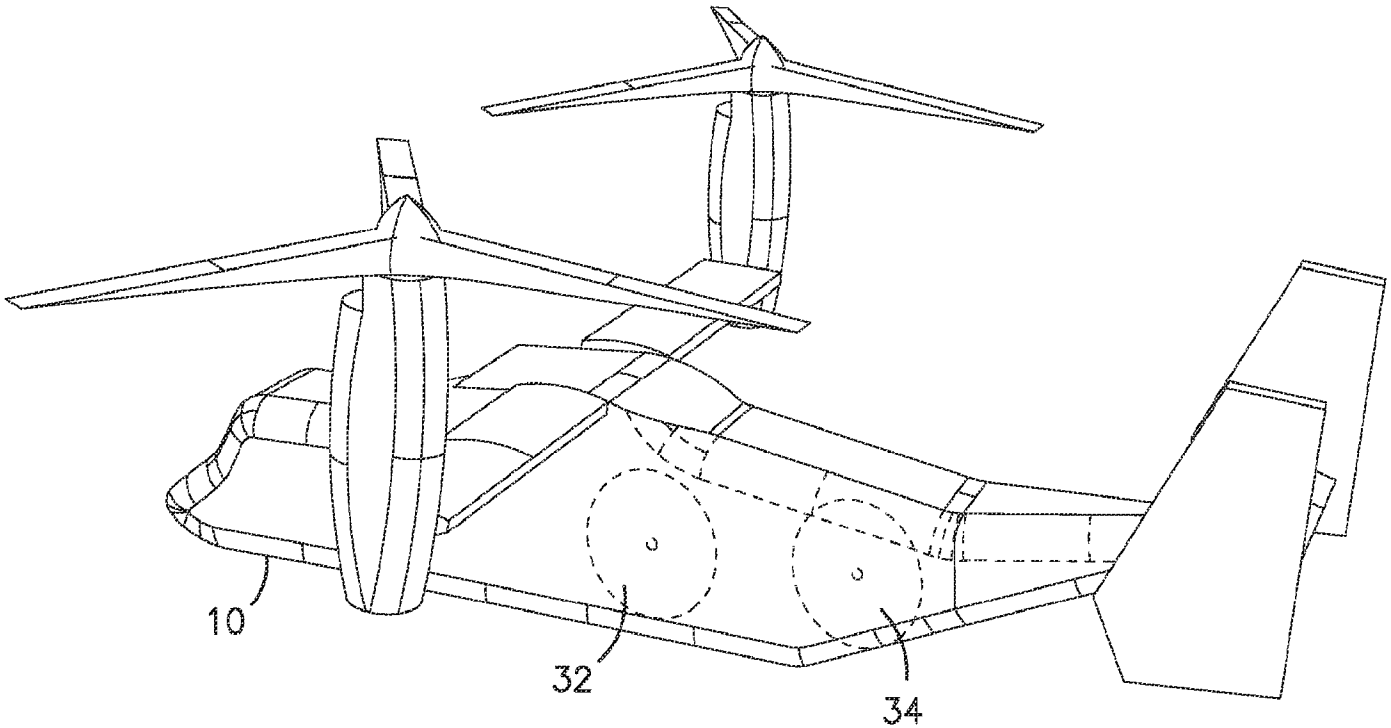
FIG. 9 is a schematic view illustrating an exemplary barrier affixed to the exterior surface of a host vehicle.

In FIG. 9 it can be seen that the barrier 12 is affixed to the outer skin of the helicopter 10. A semi-stiff but somewhat flexible barrier may easily conform to the flat or gradual curved outer surface of most vehicles, including helicopters and aircraft. Accordingly, the barrier 12 can be affixed to the exterior surface of the host vehicle and be affixed flat against that outer surface. The barrier 12 can be affixed at its outer peripheral by means of a suitable clip 32, such as a breakaway clip. The clip 32 could be separate, or could be a molded feature of the periphery of the barrier 12. Alternately, the barrier could be affixed to the aircraft fuselage by means of tape, or breakaway film covering. The aforedescribed rapid inflation means could serve to rupture the tape or film covering and free the barrier of its retaining layer at the instant of launch.

As can be seen, the tethers 16 lead away to the propulsion device and can be constrained and protected by covers 34 which run substantially over the barrier itself and thus can be prepared at the point of manufacture of the barrier 12 and integral to that barrier when it is delivered to the field for installation on the vehicle. The tether covers 34 are constructed lightly such that the tethers 16 will pull out of the covers 34 when the propulsion device 14 travels away from the host vehicle.

In any event, the retaining clips 32 holding the barrier 12 onto the host vehicles exterior surface are formed to break, or release when pulled on by the tethers 16.

In an exemplary embodiment, the clips 32 are located just under the attachment points of the tether 16, and therefore, the full force of the tether 16 is transmitted directly to the clips 32 in order to cleanly and quickly break away from the vehicle.

As alternate embodiment, of retaining the barrier 12 to the outer surface of the host vehicle, "thinwall anchors" can be used where a central lock rod may be pulled by the propulsion device and the tethers out from between two or more anchor legs, thus allowing the legs to come together to a diameter less than that of the holes that they are inserted into, thereby releasing the anchors.

An advantage of the system affixing the barrier to the exterior surface of the host vehicle is that the barrier is spread fully open and positioned substantially aligned from the instant it departs from the host vehicle. Another advantage is that the barrier does not require any valuable storage space aboard the vehicle. In the case of an aircraft, the barrier thereby does not occupy any interior space, does not require a separate external pod, does not increase the aerodynamic drag of the aircraft and the modest weight of the barrier is distributed along the full length and width of the aircraft, thereby providing the minimal impact on weight an balance of the host aircraft.

The aforedescribed system of storing the non-inflated barrier reduces the packaging job of the present missile defense systems to that of providing a launch and aiming apparatus for the propulsion devices. The stowing method lends itself to the deployment of barriers on both sides of the host vehicles, or, if desired, on the top or bottom.

In the case where the host vehicle is a helicopter, for example, it might be advantageous to affix the barriers flatly to the bottom of the aircraft, and have a swiveling propulsion device such as a tow rocket launch system that could fire in any azimuth and downwards which is the general direction that most RPG and missile threats would approach. It may prove most effective that the host vehicle have a pod of tow rockets directed substantially away from the two or more sides of the vehicle, in which case, the above flat storage would also be advantageous.

Another benefit of the flat storage system is that it provides an ideal means for stacking multiple barriers on top of each other. The attachments could be staggered slightly, either longitudinally or rotationally, so that each barrier has its own attachment, and pulling one barrier from the host vehicle would not affect the security of readiness of the barrier below that barrier. The holes or attachment points on the host vehicle to which the barrier is anchored could be in the form of metal inserts. They could be press fit, or swaged into holes in the host vehicle body, thus providing an optimally-engineered attachment, as well as preserving the integrity of the vehicle body. Attaching metal inserts to sheet metal, and in particular to aircraft, is a well known practice.

Rocket stabilization and guidance may take one of several forms depending on the system complexity as described above. In one embodiment fixed aspect aerodynamic fins 36 are used to stabilize the RTB rocket on its flight path. (See FIG. 4) The fins 36 may extend via spring pressure after ejection from the launch pod.

Another embodiment provides inertial stabilization through the use of a spinning mass. A tubular section of the rocket fuselage spins around the axis of flight. The spin motion may be imparted via an ablative multi-vane impeller that is coupled to the rotating section and situated along the rocket axis. A portion of the rocket exhaust drives the impeller. Active guidance via moveable control surfaces may also be employed. Active guidance methods are established in the art, and are not an object of the present invention.

The RTB rocket may carry flares or other IR countermeasures, thus doubling as a decoy for heat-seeking threats and attracting those threats into the effective radius of the RTB countermeasure.

The RTB may additionally be equipped with a shock wave generating device. A feature of many RPG's is that there is a sensitive piezo fuse in the nose that is armed right after the RPG is fired. As such, due to the fuse in the nose, it is not absolutely necessary to stop or capture the RPG. If a force can be applied to the fuse, the RPG will detonate and is thereby destroyed and is thereby prevented for reaching its target. It would, therefore, be advantageous with the present system to have some device to enhance the possibility of activating that trigger mechanism so that the RPG detonates and thereby is destroyed.

Accordingly, the force to detonate the fuse may be accomplished by a physical contact and that may be effected by contact with the barrier as the RPG hits the barrier, however, the contact has to be right on the nose of the RPG and may not occur a high percentage of the time. Alternatively the fuse can be detonated by a pressure wave such as is produced by some explosive destruct charge close to the RPG.

As such the present system includes an explosive destruct charge attached to or incorporated into the barrier, or separately from the barrier such as by a secondary part that trails behind the barrier that destroys or disables the missile. The destruct charge can be triggered the when force on the tethers exceeds a predetermined value. The destruct charge combines with the physical barrier to provide enhanced capabilities to the RTB system. Explosive RTBs may be effective against threats that could defeat the barrier alone (such as SAMs and personnel fired missiles).

In-flight arming of the destruct charge safeguards the host vehicle from accidental detonation and from detonation during the initial shock of the inflation of the towed barrier. In one embodiment, a MEMS G sensor integrates flight time away from the host vehicle to provide a safe arming distance. Hall-effect sensors and spring-mounted magnet provide non-contacting force trigger. The towed barrier tethers are connected to the spring-mounted magnet. After arming, the appropriate force on the tethers brings the magnet sufficiently close to the hall-effect sensors to trigger an electrical impulse to the destruct charge. Additional destruct charge fusing methods could be employed including heat sensing, proximity, or time-delay methods. The destruct charge and its control, as explained, can also be located in the propulsion device or in both the propulsion device and the barrier.

As an alternative, there can be a device that generates and releases a large electrical charge, triggered in the same manner as the previously described destruct charge and which can also detonate the explosive material in the intercepted missile.

Figure 10A:
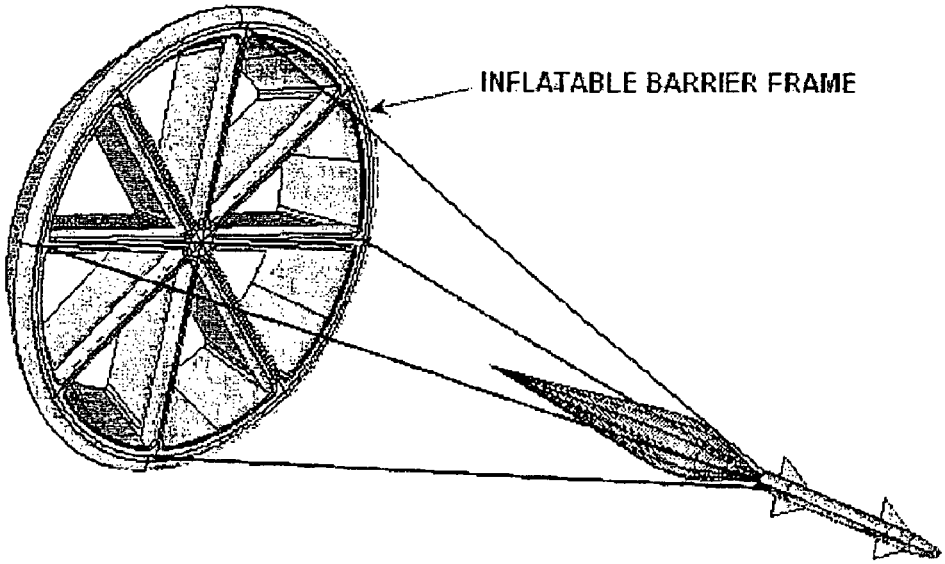
FIGS. 10-22 illustrate aspects of systems according to the principles of the invention.
Figure 10B:
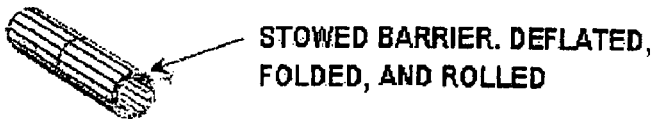

FIG. 10A shows one embodiment of an inflatable frame according to the principles of the invention. Also pictured are the tow rocket and the connecting tethers. Scale is for representation only. In general the inflatable frame provides configurable mounting and attachment for various RPG defeat schemes. In this version the frame has multiple segments. Each segment may contain the particular elements intended to defeat (i.e. catch, deflect, or disable) the RPG. Particular embodiments are described in the next section. FIG. 10B illustrates the barrier in its compact stowed form.

Figure 11:
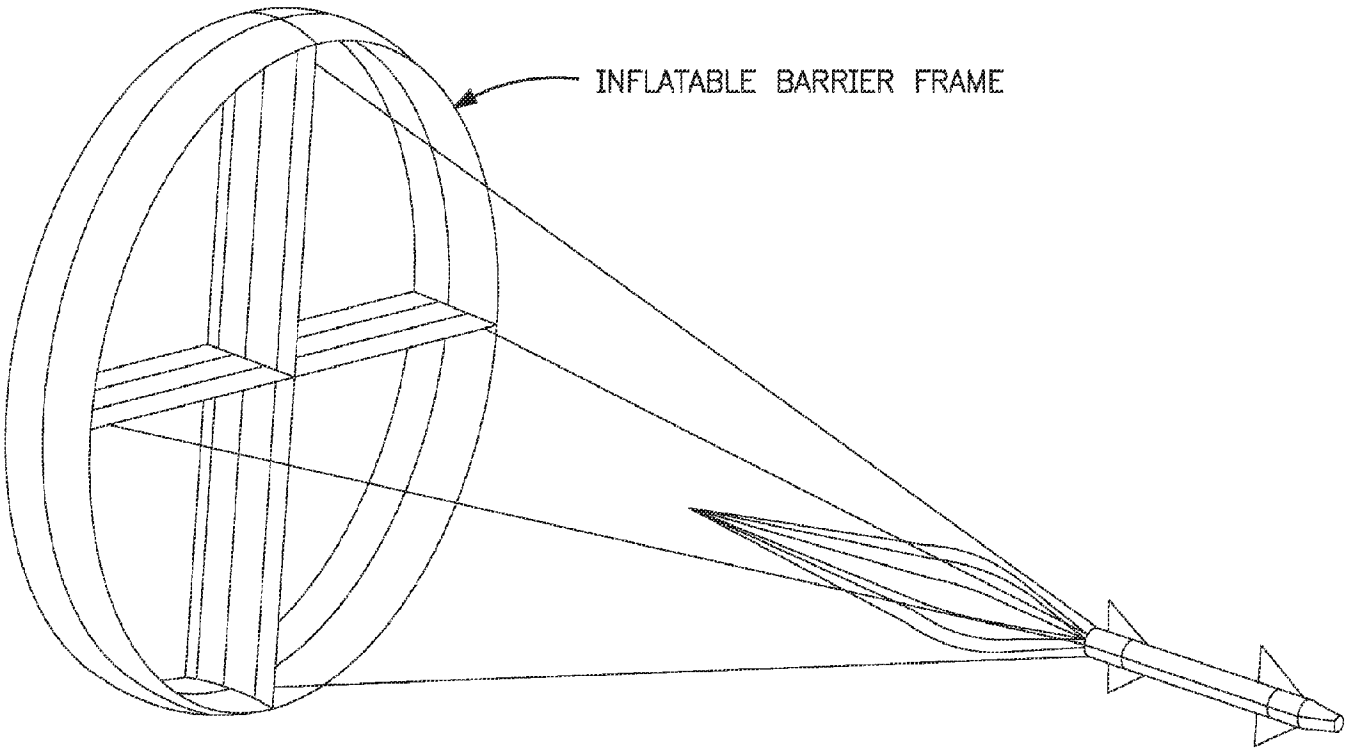

FIG. 11 shows another embodiment of the inflatable frame concept. Very rapid deployment and good standoff distance are features of the towed barrier with an inflatable frame.

Figure 12:
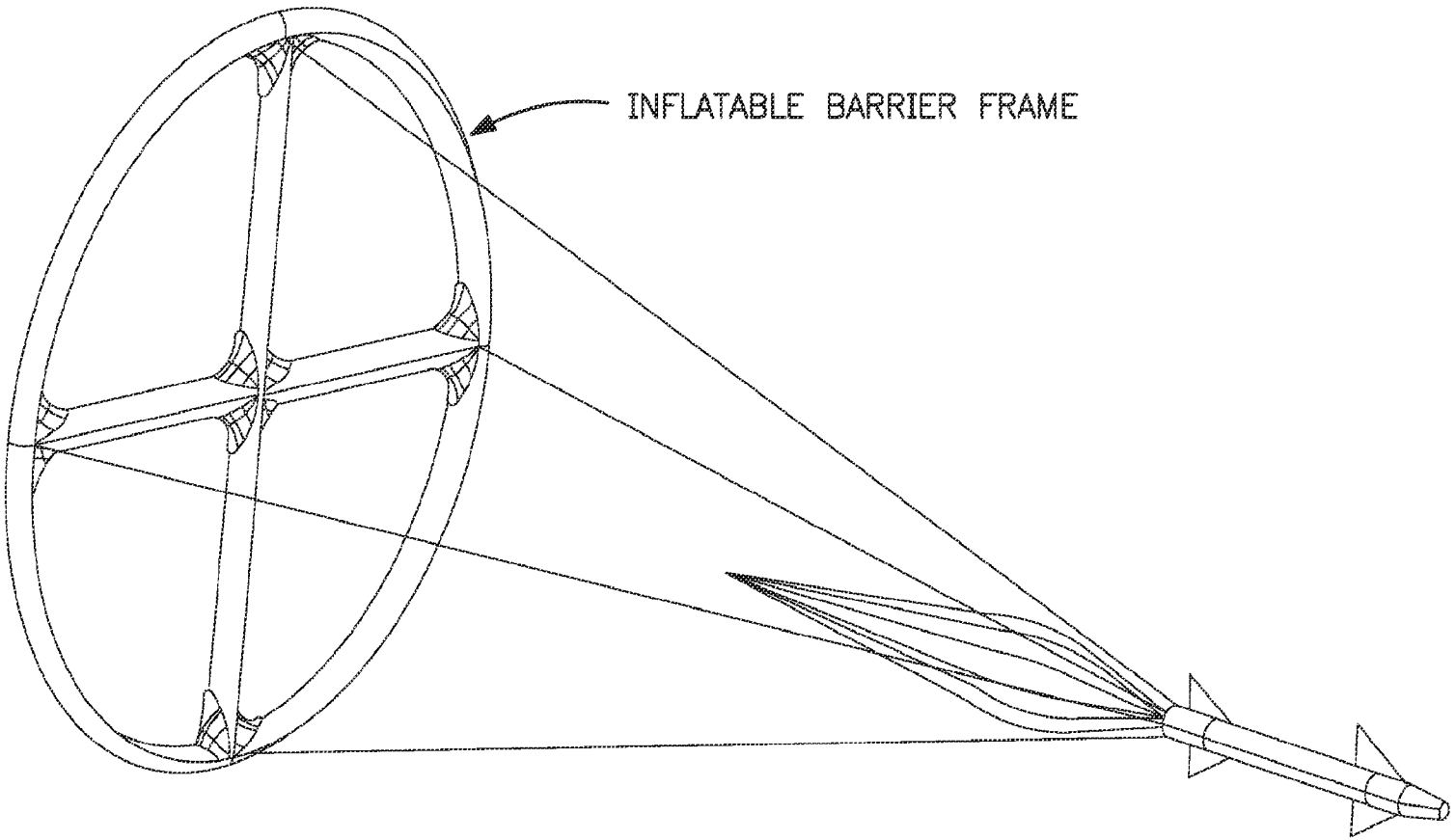

FIG. 12 depicts a simple ring-shaped inflatable frame. The frame, equipped with gas generating solid propellant inflators, provides the key capability of being able to go from a compact, deflated state, to a fully open state in milliseconds.

The frame allows for the attachment of many different types of barrier materials. The structure of the frame allows for the disposition of several layers of a given barrier fabric or material. These layers may be held in a specific orientation, with controlled spacing. Active elements such as small explosive charges or decoy flares may be placed in fixed, controlled locations, and their operations may be precisely controlled.

The frame may be shaped to provide to provide the best aerodynamic performance. Some elements of the barrier system, such as controls, detonating charges, decoy flares; may be disposed inside the inflated chamber(s) of the barrier. The material that forms the chambers of the inflatable structure does not need to be (but can be) a high-strength exotic material.

Barrier Concept: Multiple Deflecting Panels

One approach for defeating RPGs would be to place multiple deflecting panels in the path of the RPG. The panels would be made of best-in-class flexible high-strength materials. In order to successfully strike its target, the RPG must penetrate all of the panels while maintaining its exact course and speed.

Figure 13A:
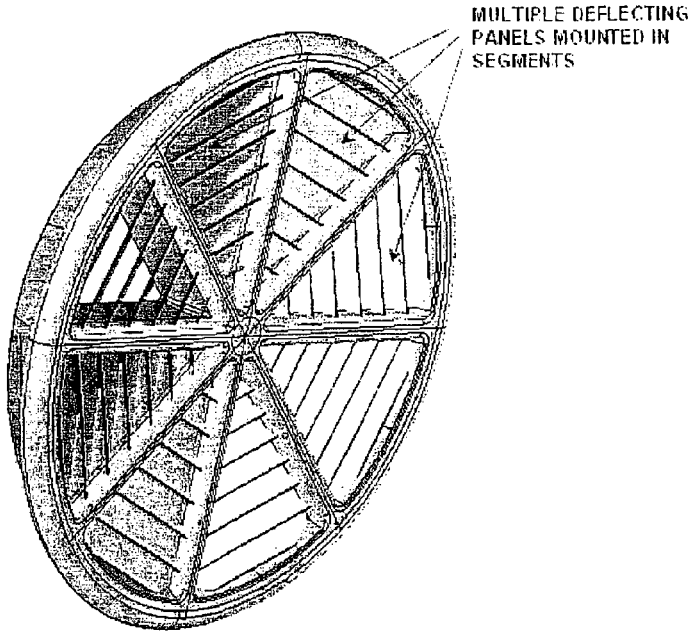

FIG. 13A depicts the multiple deflecting panels deployed within each segment of an inflatable barrier frame. The panels are mounted such that there is a controlled air gap between each panel. This allows air to flow through the entire barrier while being towed. The panels are angled at forty-five degrees, in a outward orientation. This orientation directs aerodynamic forces outward to maintain the full diameter of the barrier.

Figure 13B:
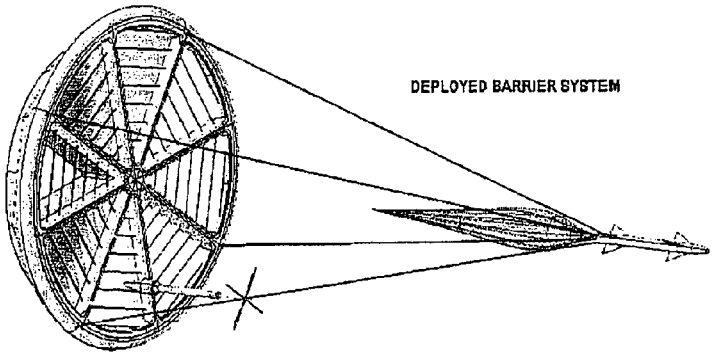
Figure 14A:
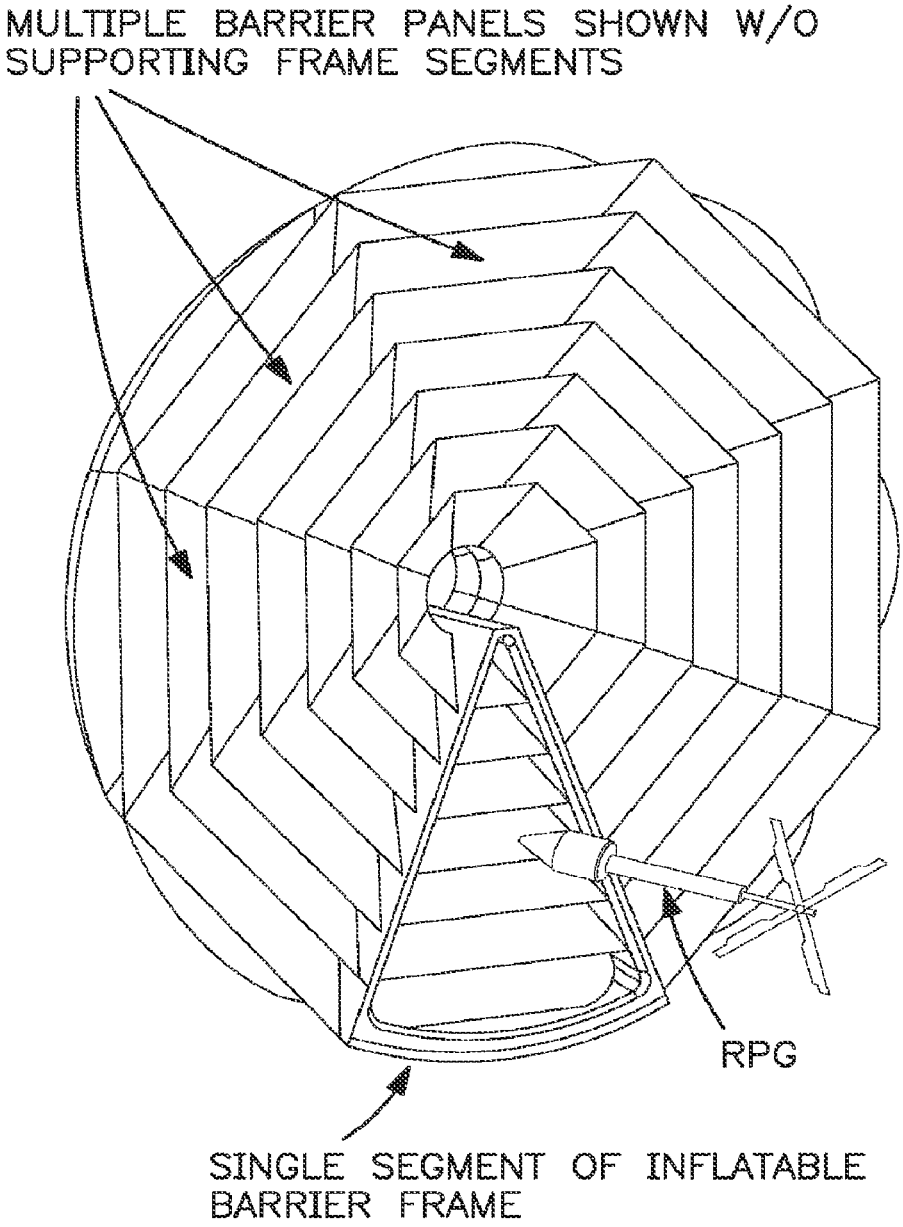
Figure 14B:
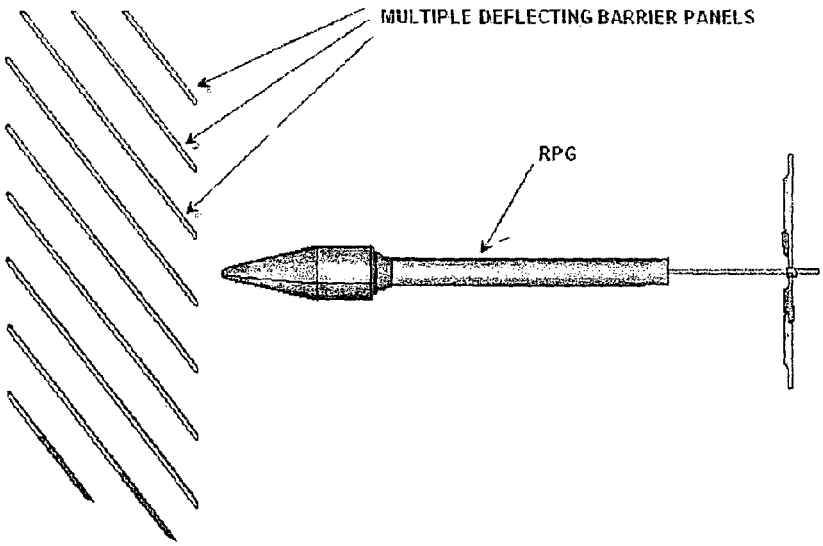

FIG. 13B depicts the actual barrier panels as they are disposed within the inflatable frame. FIGS. 14A and 14B illustrates one frame segment.

The RPG must penetrate at least three separate layers of best-in-class barrier material. The resultant force of penetrating each panel will act in a direction to deflect the RPG from its intended course, as well as to slow it down. Each panel is affixed to the resilient inflatable frame. The resilience aids the panels in dissipating the kinetic energy of the RPG. The barrier itself will deform around the location of the encounter with the RPG. This will further hinder the ability of the RPG to penetrate all of the panels and may result in some portion of the barrier becoming entangled with the RPG.

Many different specific panel materials may be used. Materials might include weaves of Kevlar®, polypropylene, or even strain hardening polymers such as polycarbonate. Polycarbonate, used for bullet-proof windows, exhibits increased toughness under deformation. As long as the barrier panels are flexible, the design requirement of being able to stow in a tight volume is preserved. In addition to fabric-type barrier panels this design can mount panels made of mesh-type materials, such as light-gage braided stainless steel cable net material. The panels could also be a combination of these.

Barrier Concept: Single or Multi-Layer Mesh

Figure 15A:
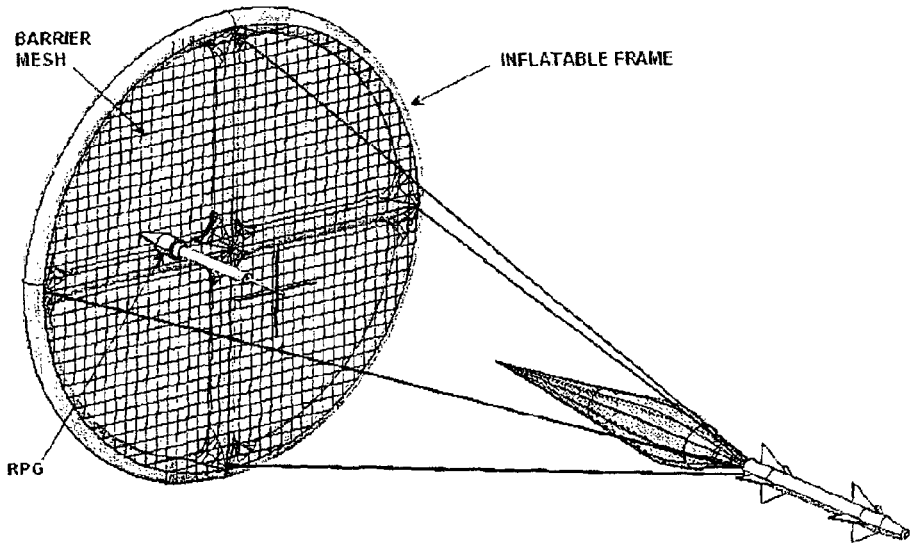

FIG. 15A illustrates another type of inflatable frame barrier consists of an outer ring and a number of crossbars. The barrier material can be fixed in front, and/or behind this ring-shaped frame.

The FIG. 15A depicts a ring-shaped inflatable barrier frame with a wire mesh material supported across it. The mesh may be single, or multiple layers.

Figure 15B:
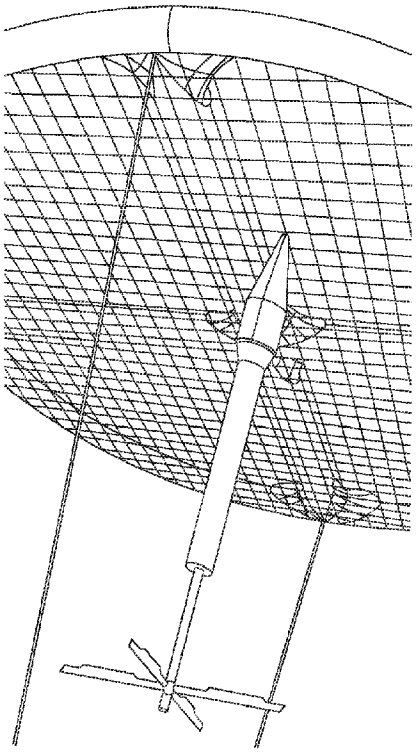
Figure 16A:
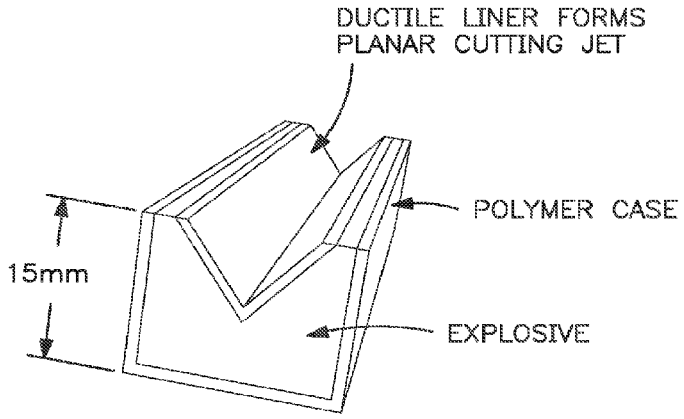
Figure 16B:
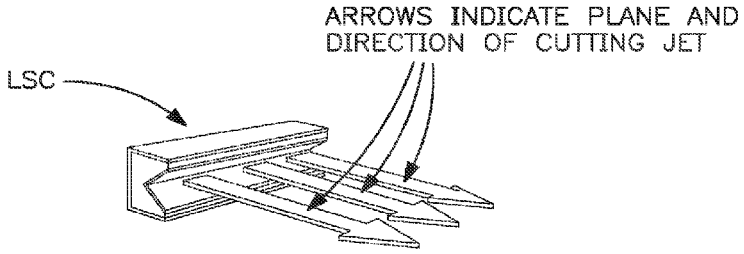
Figure 16C:
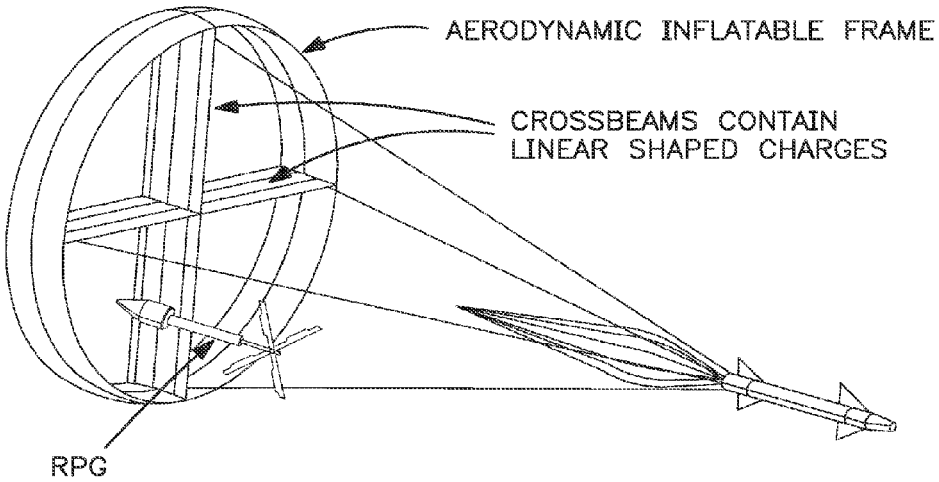
Figure 16D:
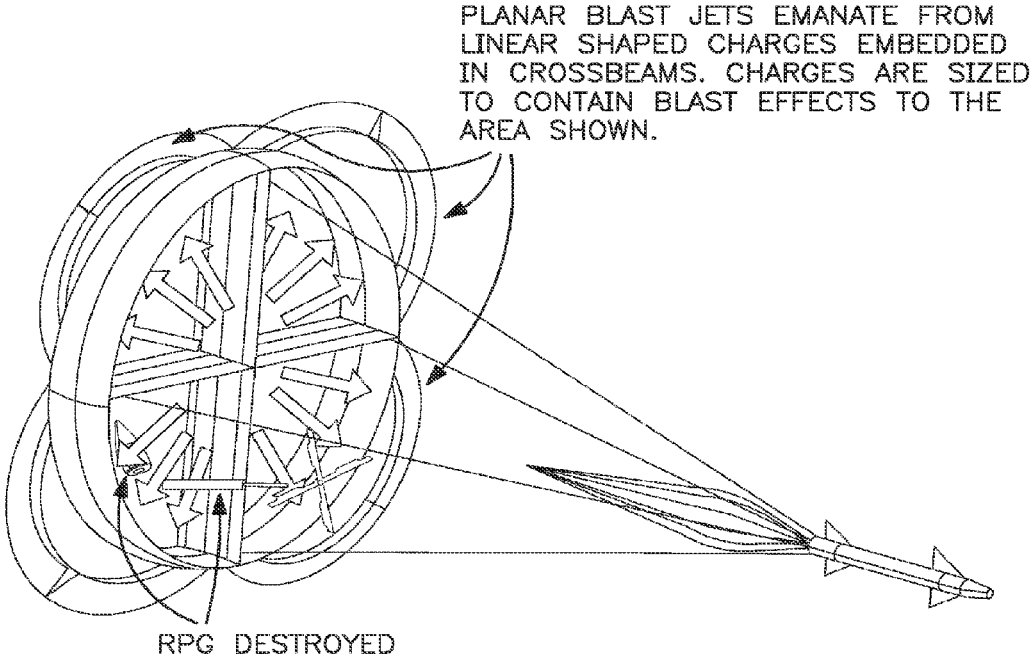

The detail FIG. 15B shows an RPG encounter with a mesh barrier. The inflatable frame can support mesh, or other barrier materials, on both sides. The mesh material may included small steel braid cables that are spot-welded together at each crossing joint. This would provide a very robust barrier sheet(s) supported by a very compliant frame. The mesh may alternately be made from a tough polymer, such as kevlar. This design would have lower drag because most of the frontal area is open.

A mesh such as shown here could also serve as a trigger mechanism. This might be done via thin and lightweight conducting wires. Such a barrier would be very compact and lightweight. These wires could serve as electrical triggers. When one or more wires are broken by an encounter with and RPG or a missile, an electrical signal could initiate a countermeasure for defeating the RPG. There may be other trigger methods as well. These might consist of proximity sensors, sensors the detect the shockwave of the passing missile, and so on. A range of countermeasures could be employed this way. One such approach would be the use of very small detonating charges. These charges would be shaped and positioned such that their effects would be highly directional and would be contained within the area of the barrier. This would alleviate the need to construct a barrier that is physically capable of stopping a missile. This would preserve the benefit of containing, to the maximum extent possible, the harmful effects of the RPG encounter and destruction. This approach is outlined in greater detail in the next section.

Barrier Concept: Planar Cutting Jet

This variant on the towed barrier system takes a completely different approach to the problem. For this barrier, the type of threats to be defended against will include supersonic missile types such as the Stinger or the AIM-9 Sidewinder. This new approach uses small explosive charges configured as a part of the inflatable barrier frame. There is no attempt to capture or physically impede the missile. Instead of a physical barrier material, the inflatable frame carries a trigger mechanism which detects the passage of a missile through the barrier frontal area. These could be a wire mesh, that will set off the explosive charges when broken. Any missile passing through the mesh will trigger the charges via direct electrical fusing. The charges are deployed inside the crossbeams of the inflatable frame, in linear segments. The segmentation allows the barrier to be tightly stowed when deflated. Through design and sizing, the effect of the charges is localized to the area of the barrier. In one embodiment, the line charges could simply induce damage to the missile via radiating blast force, or perhaps cause the missile to detonate via its own nose fuse.

In another embodiment as shown in FIG. 16A through D the explosive charge segments may be configured as a Linear Shaped Charge (LSC). LSCs are a highly developed technology and are in widespread use as cutting tools in building demolition. LSCs produce a highly directional, planar cutting jet, that can be precisely aimed and controlled through design features.

LSCs may be attached to the barrier inflatable frame such that the directed blast jet creates a cutting plane across the axis of travel of any missile passing through the barrier. Linear shaped charges are capable of cutting thick steel plate. Given the fact that all MANPAD/RPG/missile designs must comply with the constraints of aerodynamic structures (light weight, thin structures), even a modest LSC would cut through the structure of any MANPAD or missile. It would be very difficult for missile designers to counter this defeat mechanism without destroying the flight capabilities of their missiles.

A conservative estimate of the LSC planar blast jet velocity is 3.0 kilometers per second. The AIM-9 missile is representative of best-in-class supersonic air-to-air missiles. It has a maximum velocity of about 0.85 kilometers per second. Thus an LSC cutting jet has a velocity about 3.5 times as fast as the fastest missiles in the world. In other words, for every foot the threat missile travels along its axis (relatively perpendicular to the cutting plane of the LSCs), the cutting jet travels more than 3 feet. Considering a barrier of 6 to 8 feet in diameter, with LSC charges deployed along the crossbraces, it may be seen that in the worst case scenario (mach 2.5 missile passing through the outer periphery of the barrier), the threat missile will be struck by one or more cutting jets after having traveled about one linear foot into the area defined by the barrier opening. Thus by crude analysis, a towed barrier carrying linear shaped charges would be capable of destroying even the fastest and most lethal airborne missile. Some other useful features of the LSC barrier would be the elimination of the need for a capture material.

Figure 17A:
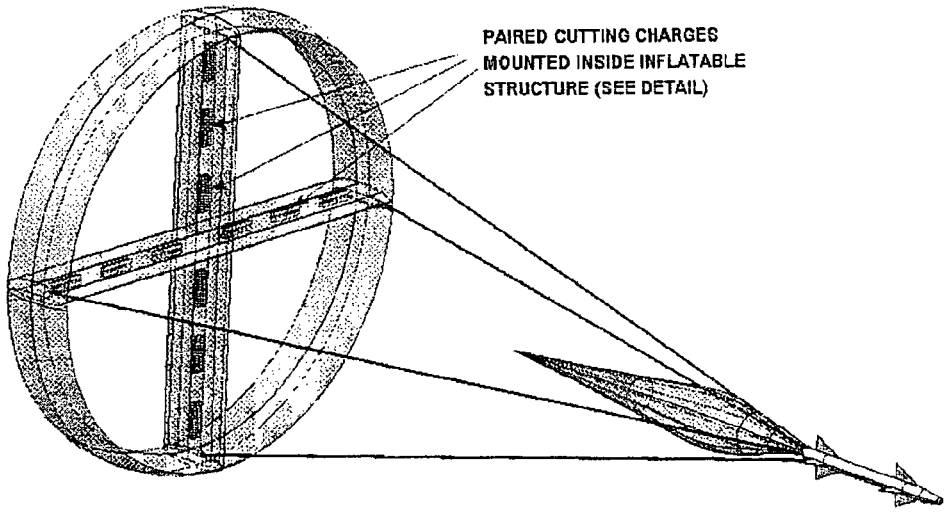
Figure 17B:
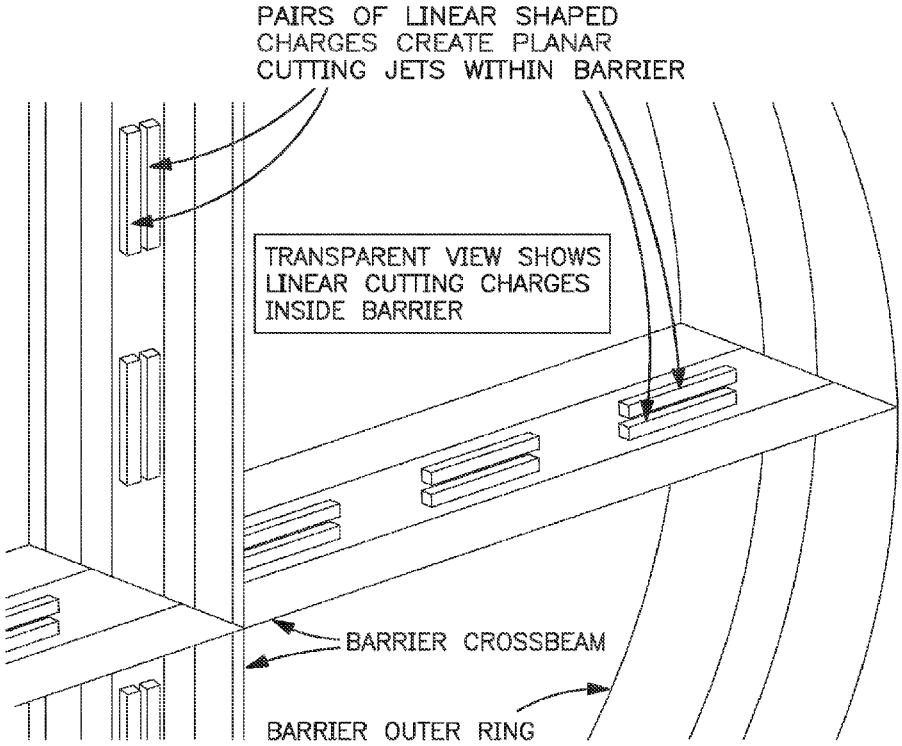

In the particular case of heat-seeking missiles, the barrier could be equipped with decoy heat sources. Unlike conventional decoy flares, the towed barrier could fly in the pathway of the approaching missile, and thus completely occlude the target aircraft heat signature. The missile seeker reticule would lock onto the barrier itself, and actively maneuver toward its own destruction. As shown in FIGS. 17A and 17B, the required LSC charges would be modest in size and could be enclosed inside the inflatable structure of the barrier frame. In this way the barrier frame could be designed for optimum aero shape, while containing the kill mechanism inside.

Triggering the LSC charges at exactly the right time is a key consideration for this barrier type. In addition to the afore-described fine wire triggers, the charges could be triggered by the shock wave of the passing threat missile acting on piezo sensitive elements located on the tow rocket. Another trigger embodiment would employ side-looking visual sensors on the tow rocket. These sensors would detect the passage of the threat missile and send a signal to the detonator.

Barrier Concept: Percussion Sheet

Figure 18:
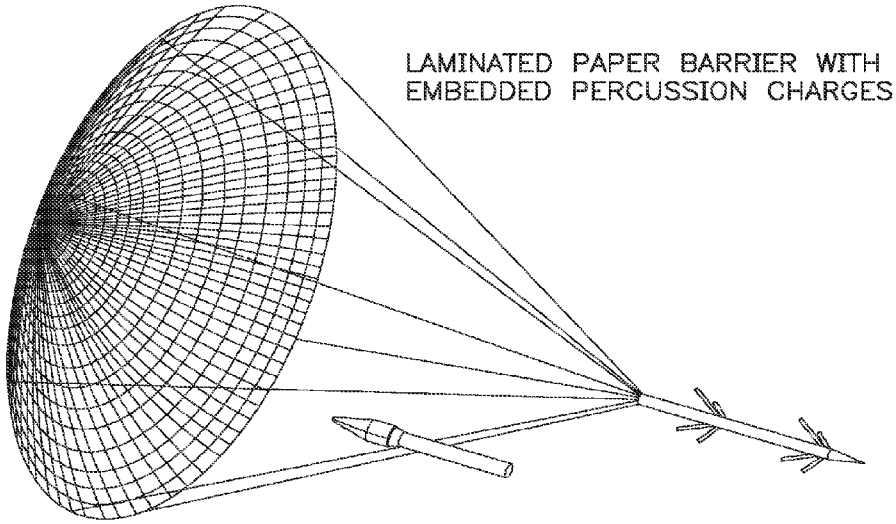

This embodiment as shown in FIG. 18 is directed at a very inexpensive barrier that causes the RPG to detonate on contact with the barrier, rather than physically impede the RPG. The RPG initial contact with a fabric barrier creates a sharp impact. The classic wavelet deformation is seen just prior to the fabric rupture. The initial impact of the RPG will provide a shock impulse that could be used to detonate very small caplets of explosive that are embedded in the barrier itself. The caplets could be of very modest explosive force, yet powerful enough to reliably detonate the piezo fuse in the nose of an. RPG. The working principle is very similar to a child's cap gun, in which the percussion of the toy hammer ignites the caps. The manufacturing principle would likewise be very similar to producing paper caps, in which small pockets of explosive are manufactured into a paper strip. The percussion of an encounter with an RPG traveling at 600 miles per hour could provide a very reliable percussion hammer effect. The barrier could be made in a manner similar to the paper cap strip. The barrier could consist of two layers of heavy paper, bonded together, with a multitude of small explosive 'bumps'. The barrier could be folded in a pleat form and coated with a polymer as weather protection, and as a toughening measure. This type of barrier could be provided with a regular pattern of tiny perforations to permit airflow, the remaining area to be covered with caplets arranged so that an RPG cannot contact the barrier without setting off at least one caplet. Tow tethers could be bonded into the sheet structure. The small explosive charges could be arranged in other patterns, such as in lines, or a mesh pattern, or as a continuous thin layer between the structural paper layers. This type of barrier could be stowed 'flat' (i.e. conforming to the outside of an aircraft or vehicle), or could be folded. In the folded case, rapid inflation could be facilitated via SPI gas generators and inflatable crossbeams. A design objective of this type of barrier might include having aerodynamic forces provide substantial inflation.

This type of barrier is envisioned to have very low production costs due to its simplicity and constituent materials (paper, gunpowder, plastic coating). The development path for this barrier might begin with testing of sample sheets to ensure reliable RPG detonation, prior to investing in aerodynamic and stowage design.

Towed Barrier RPG Defense System Overview

The major components of the towed barrier system, other than the barriers, are Stowage, Targeting, and Launch (STL). For example, a component is the threat warning and identification subsystem. This warning system must detect and classify incoming threats in milliseconds. It also must provide targeting and launch signals to the towed barrier munition. There are presently systems on the market which fulfill these requirements, and could be optimized for the present application with a minimum of development. Another key aspect of the proposed system would be aiming, and/or in-flight guidance of the towed barrier. Again, current practice in relatively low-cost missile design is more than capable of providing a highly-agile maneuvering missile.

Figure 19:
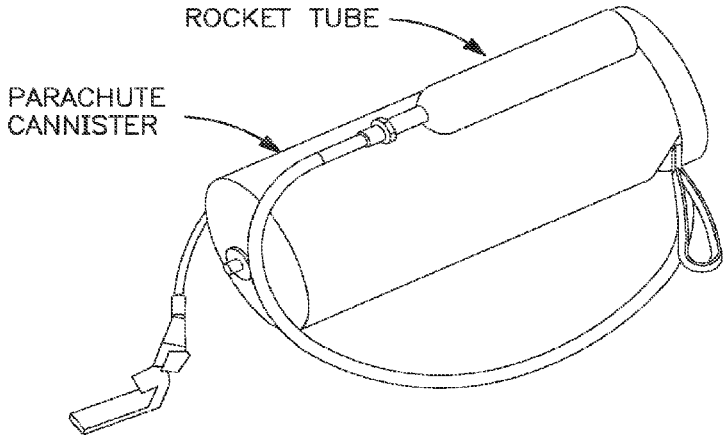

Stowage:

The present proposal is focused on an airborne system. This is the most restrictive case, and presents that greatest challenge from an engineering perspective. The basic form of the towed barrier consists of the tow rocket, and the barrier. These are connected via tethers (for convenience, the "barrier munition"). The tow rocket, tethers and barrier are intended to be stowed as a unit. The most likely deployment sequence involves the tow rocket firing out of a weatherproof tube, pulling the tethers and the barrier out of their weatherproof enclosure as the tow rocket travels away from the defended vehicle. There is a similar deployment system in current widespread use today in the form of the Ballistic Recovery System, FIG. 19. In this system, a rapid firing solid fueled rocket, fired out of a tube, pulls a large parachute out of a weatherproof enclosure via tethers.

The RPG barrier is much smaller in diameter than the parachute in a ballistic recovery system, but the principle of operation is identical. These systems prove that very fast deployment of a chute-shaped drogue via a tow rocket is practical and effective.

Figure 20:
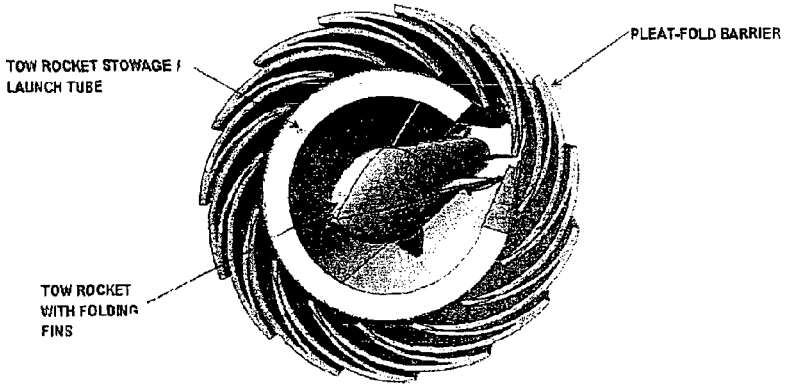
Figure 21:
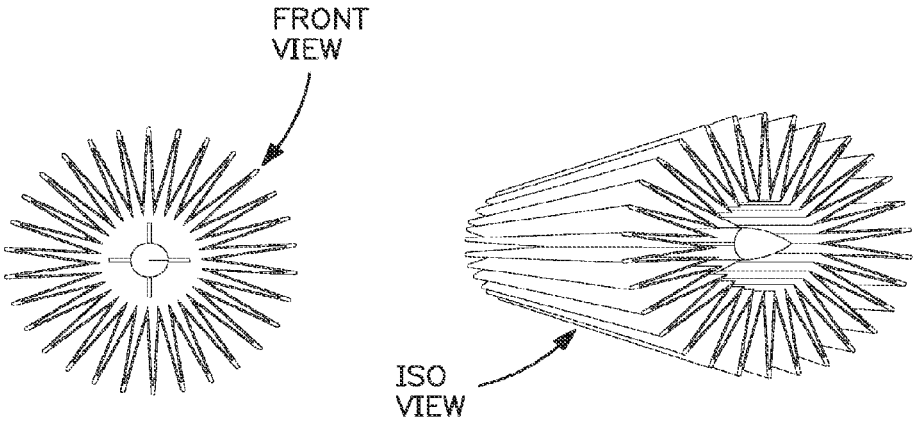

FIGS. 20-21 depict a generalized concept of stowing the barrier munition in a single tube (tube not shown), with the tow rocket nested inside the deflated and folded barrier. At launch, the tow rocket leaves first, drawing the barrier tethers out, and then the barrier. The barrier may be fitted with an inflation arming system. The inflation arming could be initiated via a simple mechanical switch that is activated when the barrier is pulled out of its stowage tube. In a simplified version, barrier inflation could be controlled by a pre-set delay from the time it exits the tube. Other inflation schemes could include simply inflating the barrier the instant it clears the tube. This could be done via a simple switch tether, with no intervening control elements. Other options could include inflation via RF signal from the host vehicle. This would allow the tow rocket to maneuver without the drag of the fully-inflated barrier.

Disposition and Aiming:

A major system consideration is how many barrier munitions should be deployed on the aircraft; and how or if they should be aimed to intercept the incoming RPG. In the case of helicopters, it is assumed that the defended area consists of the full 360 degrees surrounding the vehicle, and the elevation from level with the vehicle, extending downwards. It is assumed that RPG attack from above is unlikely. The foregoing assumptions allow the barrier munitions to be stowed on the underside of the vehicle, either in fixed or articulating mounts. Other mounting schemes that would cover the defended area include mounting on lateral stores pylons, or on the sides of the fuselage. In another embodiment, the barriers could be stowed flat, against the fuselage of the host vehicle. The barriers could be pulled away upon launch and would be in the fully-open state immediately. Barriers stowed in this way could be held against the host by a variety of pull-off or tear-off fastening means. Detachment from the host could be facilitated via gas generators, which could pop the barriers free from their mounting. These generators could be used also for shaping and stiffening the barrier.

Tow rockets may be configured as maneuvering, in which case precise aiming should not be necessary; or non-maneuvering, in which case some rapid method of aiming would be necessary in order to intercept the threat. In the maneuvering case it would be possible to place the barrier munition in fixed launch positions. These might be arranged outwardly at selected locations, roughly covering the approaches to the defended vehicle. The maneuvering tow rocket would pull the barrier into an intercepting position after launch. This mode of deployment avoids the cost, weight penalty (if any), and complexity of an aiming system. On the other hand, an aiming system would potentially allow more defensive coverage with fewer barrier munitions, and would allow for the use of non-maneuvering tow rockets. Even in the case of maneuvering tow rockets, an aiming system would reduce the need for large course corrections, and thus make the rocket/guidance design simpler. Any aiming system would have to be very fast acting, light, and weatherproof. These requirements are well within the capabilities of current off-the-shelf servo actuation systems.

Figure 22:
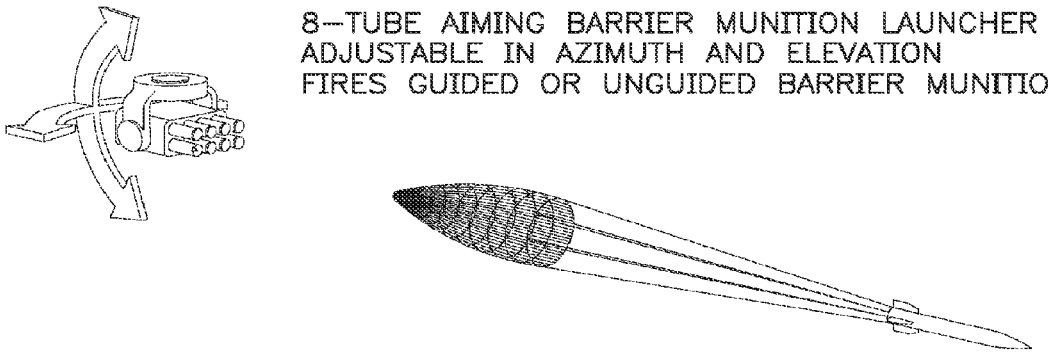

One form of an aiming launcher is depicted in FIG. 22. This could be mounted on the underside of an aircraft, for coverage in 360 degrees, or some variant of this approach could be mounted on a weapons pylon, such as is currently in use on some UH-60 helicopters. Other forms are of course possible, and the key component of any such system remains the barrier.

Targeting

It is useful for any defense system to detect, classify and respond to threats in as short a time as possible. In the case of RPG defense, the required response time may be a little as a few milliseconds. A survey of current technologies for the detection and classification of weapons fire indicates that there at least two broad types of system that would meet the requirements of an RPG defense system. One such technology is infrared detection such as by Radiance Technologies Inc. The system is claimed to be suitable for fixed and rotary wing aircraft, as well as ground vehicles.

A major requirement of any RPG defense system is the ability to react quickly enough to protect the host vehicle. RPGs are capable of traveling about 1000 meters with a flight time of about 5 seconds. In practice, these limits are almost never reached and the weapon is only effective at much shorter ranges. For this reason it must be anticipated that an effective RPG attack will present very little time in which to identify and respond. Any practical system will have to deal with this limitation. One implication of this is that there can be virtually no question of "person-in-the-loop". The system must respond autonomously. On the plus side, it should be relatively straightforward to distinguish between an actual attack and some other phenomenon. In other words, it would probably be difficult for opponents to decoy the system, by say, throwing a rock at the vehicle. The physical signatures (sound, muzzle flash, velocity, trajectory) of a real RPG are extreme, and only a real rocket-propelled device can simulate these.

Example of an Attack Scenario

A worst-case scenario (from the point of view of a helicopter under RPG attack) might be the case in which the RPG is launched from a distance of 200 meters.

The RPG initial launch velocity is about 100 meters per second for the first 100 ms. The main propellant then fires and the rocket accelerates to close to 300 meters per second. This acceleration is not instantaneous, and we might assume that the RPG reaches its maximum velocity at the end of the 200 meters. Reliable flight performance data is not readily available, so this rough analysis will assume a fairly linear speed gradient between main rocket ignition and attainment of maximum velocity. Thus we can use a average velocity of 200 meters per second for the 190 meters after the initial boost. This attack scenario yields a total available time budget of about 1000 milliseconds, from time of launch to time of impact. All of this time is not available to the system. There must be some time allowed for the barrier munition to achieve a separation distance from the host vehicle. Fortunately, a separation of even 10 yards will mitigate most of the high-order effects of the blast jet formed by a perfect detonation of the RPG. Of course, it is one objective of the barrier system to prevent high-order detonation of the RPG, as well as preventing the RPG from getting near the host vehicle. This analysis assumes a 500 millisecond "cushion" within which the barrier travels away from the host vehicle. The barrier inflation may occur concurrently within this outbound travel. A conservative estimate of the time required for the launch of a solid fueled tow rocket that has been designed to launch quickly is 200 milliseconds. This would leave 300 milliseconds for all system processes prior to tow rocket launch signal. This is a very generous timeframe for the execution of real-time software algorithms, which can generally run in just a few milliseconds or less.

The events that have to fit into the available time budget are:
detection and information processing—300 ms
rocket launch—200 ms
outbound travel and barrier inflation (may be concurrent)—500 ms The above events total 1000 milliseconds. The defensive launch occurs at 500 milliseconds. This would leave 500 milliseconds of remaining flight time for the RPG prior to impact which the host vehicle. Assuming the worst case that the RPG was traveling at 200 meters per second from the instant the main rocket fired, this still means the RPG has covered only 100 meters at the point the barrier munition is launched. Assuming the barrier inflation may be initiated at the discretion of the system, the tow rocket and its payload may speed toward the intercept for some distance prior to barrier inflation. Assuming the tow rocket is only half as fast as the RPG, this equates to an intercept at 25 meters distance from the host vehicle. This is far more than needed to completely negate any effects from the RPG. It is probable that a separation of 10 meters would be sufficient to render the high-order explosive jet (the primary mode of inflicting damage via RPG) ineffective. This is assuming the RPG achieves high-order detonation AND remains on course after the encounter with the barrier. Secondary blast effects at this distance would be negligible as well. Thus for RPG attacks conducted at the ideal range (from the attacker's perspective) for lethality and accuracy, the response latencies of the towed barrier defense system fit within the time available. If the foregoing analysis is reasonably accurate, then the towed defense system would be capable of defending successfully against RPG attack from ranges much closer than 200 meters.

Other Cases

For the case in which the RPG is launched at very close ranges, say 100 meters, the system can initiate barrier inflation as the barrier is exiting its stowage container. This would still offer the probability of preventing the RPG from impacting the host vehicle.

Those skilled in the art will readily recognize numerous adaptations and modifications which can be made to the rocket propelled barrier defense system of the present invention which will result in an improved system, yet all of which will fall within the scope and spirit of the present invention as defined in the following claims. Accordingly, the invention is to be limited only by the following claims and their equivalents.

What is claimed is:

1. A system for intercepting a projectile comprising:
a propulsion device adapted to be launched to propel itself through air,
a barrier comprising an inflatable frame having a compact deflated state and an open inflated state, said barrier including an inflator which when actuated after the propulsion device is launched inflates the inflatable frame to change from said deflated state to said inflated state, and
at least one tether attaching the barrier to the propulsion device,
wherein the propulsion device when launched pulls the at least one tether and the barrier through the air along a trajectory of the propulsion device for intercepting the projectile.

2. The system of claim 1, wherein the barrier further comprises intercrossing steel cables attached to the inflatable frame.

3. The system of claim 2, wherein the steel cables are welded together at the intercrossing locations.

4. The system of claim 2 wherein the steel cables are at least partially encased in a plastic coating.

5. The system of claim 1 wherein the barrier further comprises strain hardened plastic reinforced by steel cable and attached to the inflatable frame.

6. The system of claim 1 wherein the barrier further comprises a plurality of deflecting panels attached to the inflatable frame, wherein ones of the panels define an air-gap in relation to each other.

7. The system of claim 6 wherein ones of the deflecting panels are arranged to overlap in relation to an oncoming projectile.

8. The system of claim 1 wherein the inflator includes a solid propellant.

9. The system of claim 1, wherein the at least one tether comprises at least one tether affixed to a central area of the barrier and at least another tether affixed proximate to the peripheral area of the barrier.

10. The system of claim 1, wherein the at least one tether comprises a plurality of tethers comprised of an energy absorbing material.

11. The system of claim 1 wherein the inflatable frame is in the compact deflated state and the barrier is folded into a plurality of pleats to surround the propulsion device.

12. The system of claim 1 wherein the inflatable frame is in the compact deflated state and the barrier is folded into a plurality of overlapping flaps to surround the propulsion device in the compact deflated state.

13. A system for intercepting a projectile comprising:
a propulsion device adapted to be launched to propel itself through air,
a barrier comprising an inflatable frame having a compact deflated state and an open inflated state, said barrier including an inflator which when actuated after the propulsion device is launched inflates said inflatable frame to change from said deflated state to said inflated state, and
at least one tether attaching the barrier to the propulsion device,
wherein the propulsion device when launched pulls the at least one tether and the barrier through the air along a trajectory of the propulsion device for intercepting the projectile,
said barrier further comprising at least one shock wave generating device for diverting the intercepted projectile.

14. The system of claim 13 wherein the shock wave generating device is affixed to the barrier.

15. The system of claim 13 wherein the shock wave generating device is an explosive device.

16. The system of claim 13 wherein the shock wave generating device creates an electrical shock.

17. The system of claim 16, comprising at least two tethers, wherein one of the at least two tethers has less flexibility than at least another one of the at least two tethers.

18. A host vehicle having an outer surface and having a system for intercepting a projectile, said system comprising:

a propulsion device, a launch device for launching the propulsion device, the launch device being attached to the host vehicle, and a barrier releasably affixed to the outer surface of the host vehicle and attached to the propulsion device by means of at least one tether, wherein the propulsion device when launched by the launching device pulls the at least one tether and the barrier through the air along a trajectory of the propulsion device for intercepting the projectile.

19. The host vehicle as defined in claim 18 wherein the barrier comprises a mesh barrier that is releasably affixed to one or more exterior sides of the outer surface of the host vehicle.

* * * * *